US008251616B2

(12) United States Patent
Homsi

(10) Patent No.: US 8,251,616 B2
(45) Date of Patent: Aug. 28, 2012

(54) METHOD AND APPARATUS FOR PILE DRIVING

(75) Inventor: Elie H. Homsi, Broomfield, CO (US)

(73) Assignee: Flatiron Constructors, Inc., Firestone, CO (US)

( * ) Notice: Subject to any disclaimer, the term of this patent is extended or adjusted under 35 U.S.C. 154(b) by 47 days.

(21) Appl. No.: 12/983,304

(22) Filed: Jan. 1, 2011

(65) Prior Publication Data

US 2011/0164928 A1 Jul. 7, 2011

Related U.S. Application Data

(60) Provisional application No. 61/291,860, filed on Jan. 1, 2010.

(51) Int. Cl.
*E02D 7/02* (2006.01)

(52) U.S. Cl. ..... 405/232; 173/28; 173/185

(58) Field of Classification Search ..... 405/229, 405/231, 232, 253; 173/22–28, 184–189
See application file for complete search history.

(56) References Cited

U.S. PATENT DOCUMENTS

| | | | | |
|---|---|---|---|---|
| 2,014,631 | A * | 9/1935 | Pace et al. | 173/184 |
| 2,040,668 | A * | 5/1936 | Nichols | 173/192 |
| 2,822,671 | A * | 2/1958 | Dentz et al. | 405/243 |
| 3,181,623 | A | 5/1965 | Lindgren | |
| 3,442,338 | A | 5/1969 | Broderson | |
| 3,490,548 | A | 1/1970 | Lake | |
| 3,645,343 | A * | 2/1972 | Mays | 173/195 |
| 3,827,508 | A * | 8/1974 | MacKinnon | 405/232 |
| 4,075,858 | A | 2/1978 | Frederick | |
| 4,124,081 | A | 11/1978 | Deike | |
| 4,311,416 | A * | 1/1982 | Rusche | 405/232 |
| 4,365,675 | A | 12/1982 | MacKinnon | |
| 5,551,519 | A | 9/1996 | Pach | |
| 6,047,771 | A | 4/2000 | Roynestad | |
| 6,234,719 | B1 | 5/2001 | Roynestad | |
| 7,198,115 | B2 | 4/2007 | Cardoso | |
| 2011/0129307 | A1* | 6/2011 | Wong | 405/232 |

FOREIGN PATENT DOCUMENTS

| | | | |
|---|---|---|---|
| JP | 2003013449 | A | 1/2003 |
| JP | 2006291643 | A | 10/2006 |

OTHER PUBLICATIONS

International Search Report and Written Opinion by the International Searching Authority for PCT/US2011/020002.

* cited by examiner

*Primary Examiner* — Frederick L Lagman
(74) *Attorney, Agent, or Firm* — Christopher J. Kulish

(57) ABSTRACT

The present invention is directed to a pile driver with a lead that is capable of receiving and supporting a pile in a substantially horizontal orientation and subsequently rotating the lead and received pile from the substantially horizontal orientation to a substantially vertical orientation needed before the pile can be driven into the earth. In one embodiment of the pile driver, the chassis is of a relatively short length to be more maneuverable and the lead is capable of supporting a long and/or quite massive pile. To prevent the chassis, lead, and pile from tipping or being placed in an unstable condition, the pile driver further comprises a movable counterweight system. The method is also directed to methods of using such a pile driver to accomplish the driving of a pile.

22 Claims, 38 Drawing Sheets

METHOD AND APPARATUS FOR PILE DRIVING

FIELD OF THE INVENTION

The present invention relates to the driving of a pile into the earth—the driven pile forming at least a portion of a vertical support for the laterally or horizontally extending portion(s) of a bridge, viaduct, aqueduct, or similar structure.

BACKGROUND OF THE INVENTION

Typically, the piles that are employed in a bridge are relatively long. For example, piles that are 40 meters and more in length are not uncommon. Such a pile is typically prefabricated off-site and, due to the substantial length of the pile, placed in a substantially horizontal orientation for transport to the construction site by truck, train, or other suitable conveyance. At the site, a pile driver is positioned at the location at which the pile is to be driven into the ground. The pile driver includes a lead (i.e., a structure for holding the pile) that is oriented and adapted to hold the pile in a substantially vertical position. Commonly, the lead is oriented so as to hold the pile above the location at which the pile is to be driven into the ground. To move the pile from the ground, truck, train, or other conveyance to the lead, one or more crawler cranes are commonly employed. Multiple cranes are generally needed when the pile has a substantial mass (e.g., when the pile is a relatively long, solid structure made of rebar and concrete) or when the pile is lengthy. The cranes or cranes must not only move the pile from the location of the truck or other conveyance to the location of the pile driver but must also rotate the pile from its substantially horizontal orientation on the truck or conveyance to the substantially vertical orientation required for the pile to be received by the lead of the pile driver.

SUMMARY OF THE INVENTION

The movement of a pile from its substantially horizontal orientation on a truck or other conveyance to the substantially vertical orientation required for the pile to be received in the lead of the pile driver typically requires complex rigging of the crane or cranes, is commonly quite time consuming, and on occasion results in the pile being damaged so that it is unusable or damage to the equipment at the site. The present invention addresses this issue by providing a pile driver with a lead that is capable of receiving and supporting a pile in a substantially horizontal orientation and subsequently rotating the lead and received pile from the substantially horizontal orientation to a substantially vertical orientation needed before the pile can be driven into the earth. In one embodiment, the pile driver comprises a vehicle chassis and a lead that is mounted on the chassis and capable of rotating a pile from a substantially horizontal position to a substantially vertical position. In a preferred embodiment, the vehicle chassis is a tracked vehicle chassis that includes a pair of tracks for engaging the underlying surface and being used to move the pile driver from one location to another location. A chassis that employs wheels with tires is also feasible, as well as a vehicle chassis that employs both tracks and wheels with tires (e.g., a half-track).

In one embodiment of the pile driver, the chassis is of a relatively short length to be more maneuverable, and the lead is capable of supporting a long and/or quite massive pile. To prevent the chassis, lead, and pile from tipping or being placed in an unstable condition, the pile driver further comprises a movable counterweight system. The system operates to position a counterweight so as to counteract the overturning moment associated with the pile. The overturning moment associated with the pile typically depends on several factors. Among the factors that can affect the overturning moment produced by the pile are the length, mass, and density distribution of the pile, the position of the pile in the lead, and the rotational position of the pile in the lead. In one embodiment, a table and/or graph system is employed that allows an operator to look up the position or range of positions at which the counterweight should be positioned for a particular pile that is to be received by the lead or that is already resident in the lead and is or will be in the process of being rotated from one rotational position to another rotational position. Typically, the operator will cause the counterweigh to be positioned at a first location that is suitable for receiving the pile in the lead and for then rotating the lead and received pile to a rotational position that is not the final rotational position. In this situation, after the lead and pile reach the intermediate rotational position, the operator again consults the table and/or graph to determine a new position or range of positions for the counterweight for further rotation of the lead and pile and causes the counterweight to be positioned accordingly. The rotation of the lead and the pile is reinitiated. This process may be repeated a number of times before the lead and received pile reach the final rotational position. Another embodiment employs a computer that receives the relevant data from an operator, one or more sensors, another computer, or a combination of operator, sensor(s), and other computer (s) and provides the operator with the position or range of positions for the counterweight. Typically, the data is updated as the lead and received pile are rotated and the operator is provided with a position or range of positions of the counterweight suitable for the next incremental rotation of the lead and received pile. In yet a further embodiment, a computer is employed that: (a) initially receives the relevant data from an operator, one or more sensors, another computer, or a combination of operator, sensor(s), and other computer(s); (b) receives updated data as the pile progresses from being received in the load to its final rotational position; and (c) causes the position of the counterweight to be adjusted if the updated data indicates that the position should be adjusted. Typically, the updated data being provided to the computer does not include any operator input. In this case, there is little, if any, operator involvement when the lead and received pile are being rotated from a substantially horizontal position to the final, substantially vertical position.

In a further embodiment, a pile magazine that is capable of holding multiple piles is associated with the lead. The magazine operates so that a pile in the magazine can be brought into position for being engaged by the hammer or other structure associated with the hammer, removed from the magazine, and then driven into the ground by the hammer. The magazine allows multiple piles to be driven without having to stop between the driving of each pile to have a new pile associated with the lead. In one embodiment, the magazine is attached to the lead and reloading of the lead is typically accomplished by placing the lead in a substantially horizontal position, placing the magazine in condition to receive one or more piles, and then loading the pile or piles into the magazine. In another embodiment, the magazine is capable of being attached to and detached from the lead. By using two such magazines, downtime can be reduced. To elaborate, the magazine that is not currently attached to the lead is loaded with one or more piles while the other magazine is attached to the lead. After the magazine attached to the lead is removed from the lead, the magazine that was detached from the magazine and is now loaded with one or more piles can be quickly attached to the lead. In one embodiment, the magazine is linear. In another embodiment, the magazine is circular/cylindrical.

The present invention also provides a method for positioning a pile for driving by a pile driver that includes providing a pile driver with a lead that is capable of being placed in a substantially horizontal position, receiving a pile while in this position, supporting a pile in this position, and rotating a pile from this position to a substantially vertical position. In one embodiment, a straddle crane (with or without a lifting beam) is used to lift a pile from a truck or other conveyance, transport the lifted pile in a substantially horizontal orientation to the pile driver, and load the pile into the substantially horizontally oriented lead of the pile driver. In another embodiment, a crawler crane with a lifting beam is employed to move a pile from a truck or other conveyance to the substantially horizontally positioned lead of the pile driver such that the pile is maintained in a substantially horizontal orientation during the move.

In yet a further embodiment, a pile is moved from the truck or other conveyance or the ground directly to the lead, i.e., without the use of an intermediate device such as a straddle crane or crawler crane. In this embodiment, the pile is pushed and/or pulled onto the lead. In one particular embodiment, a winch system associated with the lead is used to pull the pile from the truck or other conveyance onto the lead. In one embodiment, the pile driver includes a turntable that supports the lead. In this embodiment, the turntable is rotated so that the end of the lead from which the pile extends when the pile is being driven can be substantially brought into alignment with the pile on the truck or other conveyance. To facilitate the alignment of the lead with the pile, the truck or other conveyance in one embodiment includes one or more jacks and rollers that allow the position of the pile on the truck to be adjusted. After the pile is transferred from the truck or other conveyance, the turntable can then be rotated to the appropriate position for the subsequent driving of the pile.

DETAILED DESCRIPTION

Figure 1A:
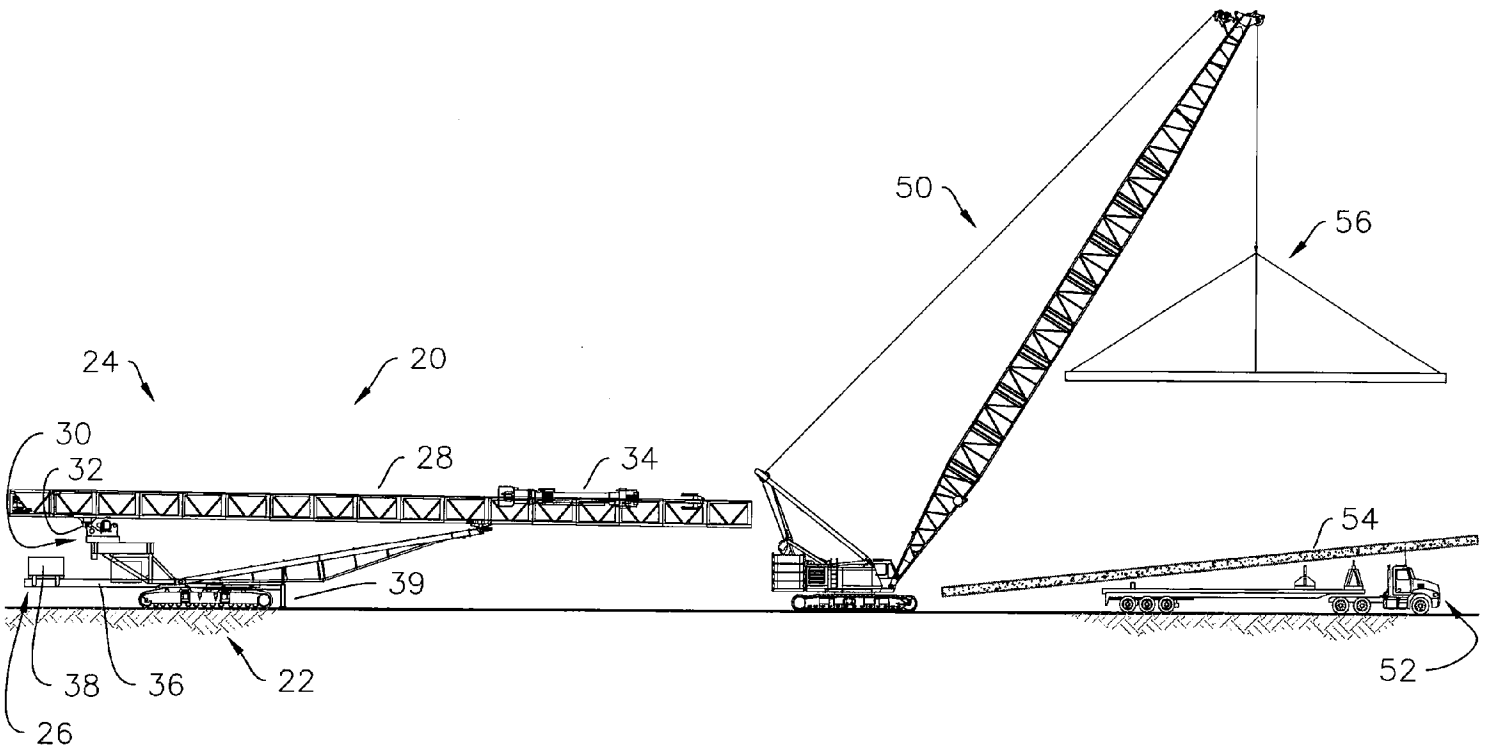
FIGS. 1A-1H illustrate an embodiment of a pile driver and an embodiment of a method that utilizes the pile driver in establishing a pile in the earth.

With reference to FIGS. 1A-1H, an embodiment of a pile driver that includes a rotatable lead which is capable of being rotated into a substantially horizontal orientation to receive a pile and then rotated to a substantially vertical position for the driving of the pile into the earth (hereinafter "pile driver 20") is described together with a method of using the pile driver 20. The substantially vertical position to which the lead can be rotated contemplates the driving of a "straight" pile (i.e., a plumb pile) that is oriented substantially 90° relative to horizontal and the driving of a "battered" pile that is oriented between 90° and about 80° relative to horizontal. The pile driver 20 is comprised of a chassis 22 that supports a rotatable lead system 24 and a movable counterweight system 26.

In the illustrated embodiment, the chassis 22 is comprised of a frame that supports an engine/motor, a pair of tracks, a transmission for conveying power from the engine/motor to the tracks, a turntable, a transmission for conveying power from the engine/motor to the turntable, a steering system for controlling the operation of the tracks in selectively turning the chassis, a turntable control system of placing the turntable at a desired rotational position, and other elements of a conventional crawler chassis. It should be appreciated that a chassis that employs a different traction system (e.g., wheels/tires or a combination of tracks and wheels/tires (e.g., a half-track)) is also feasible. A preferred embodiment of the crawler employs a multi-directional turntable whose position can be adjusted. In one embodiment, the turntable has x-y positioning capability, i.e., the turntable can be laterally moved (i.e., towards one side or the other side of the crawler) and longitudinally moved (i.e., towards the front or back of the crawler). This allows for relatively fine positioning of the lead and any resident pile, thereby avoiding the need to rely only on the steering system to position the lead and any resident pile. In an embodiment of the crawler that does not employ an engine and relies exclusively on electrical power, the crawler includes an interface for receiving electrical power via what is commonly referred to as an "umbilical cord."

The rotatable lead system 24 is comprised of a lead 28 that is operatively attached to the turntable and capable of being rotated from a substantially horizontal orientation to a substantially vertical orientation while supporting a pile. The rotation is accomplished using a lead drive system 30 that can cause the lead to rotate about a horizontal axis or first axis that is perpendicular to the longitudinal axis of the chassis 22 at pivot 32. Preferably, the lead drive system 30 is capable of positioning the lead within 10° of vertical, i.e., within 80° to 100° relative to the longitudinal axis of the chassis. Preferably, the lead drive system 30 also provides for the ability to rotate the lead about a second axis that is perpendicular to and intersects the horizontal axis associated with pivot 32. Thus, the lead 28 can be positioned anywhere within a square pyramid volume whose apex is at the intersection of the second axis and the longitudinal axis of the lead and whose lateral surfaces are each about 10° from the apex. As such, the lead 28 is capable of being used to drive straight piles and battered piles. In the illustrated embodiment, the lead drive system 30 employs a combination of a winch and hydraulics in rotating the lead 28 about the first axis. The power to operate the winch is provided by the engine/motor associated with the chassis and conveyed to the winch using a clutch and transmission system known to those skilled in the art. The engine/motor associated with the chassis also provides the power to operate the hydraulics. The hydraulics that are provided with power-from the engine/motor associated with the chassis are also employed to rotate the lead 28 about the second axis. The combination of the elements that cooperate to apply a rotational force to the lead 28 and any supporting framework for the lead are referred to as a lead motor. In should be appreciated that a lead motor that can be realized in a number of ways known to those skilled in the art. For example, power can be provided for the lead motor by an electrical motor or internal combustion engine, to name a few. Further, mechanical systems for transmitting the energy produced by a motor/engine can employ a winch, one or more pulleys, gears, racks, pinions, hydraulic jacks etc., and various combinations of such elements as known to those skilled in the art. In the embodiment illustrated in FIGS. 7A-7F, the lead 28 is extendable to accommodate particularly long piles. Further, the lead 28 is a pile driving lead that supports a pile driving hammer 34 whose position along the lead is controlled using a winch. U.S. Pat. No. 7,520,014 B2, which is incorporated herein by reference, discloses rotatable lead systems that can be adapted to the chassis 22, one system utilizes hydraulics to rotate the lead and the other system employs a winch to rotate the lead.

The movable counterweight system 26 is comprised of a support table 36 and a counterweight 38 that is capable of being positioned at a desired location along the support table 36 to counter the moment of a pile resident in the lead 28 and prevent the pile driver 20 from tipping. The table 36 extends from a first terminal end to a second terminal end with each end located outside the outer or lateral boundary of the chassis 22. As such, the counterweight 38 is capable of being positioned beyond the outer or lateral boundary of the chassis. The table 36 and counterweight 38 are coupled to the turntable of the chassis such that the table 36 and counterweight 38 rotate with the turntable. One end of the support table 36 extends beyond the front end 37A of the chassis (i.e., the front most surface of the treads) and the other end of the support table 36 extends beyond the rear end 37B of the chassis (i.e., the rear most surface of the treads). The front and rear ends 37A, 37B of the chassis roughly correspond to the points about which the chassis would tip under appropriate circumstances and in the absence of the movable counterweight system 26. As such, the table 36 allows the counterweight 38 to be positioned over a range of positions such that tipping can be prevented. The system 26 also includes an outrigger 39 that can be deployed from the rear of the chassis 22 to engage the ground to deter tipping of the pile driver 20 in certain situations. As can be appreciated from FIGS. 8A-8F, the pile driver 20 employs two of the movable counterweight system 26, one on each side of the turntable. The two counterweight systems operate in a mirror fashion. As such, only one of the system 26 is described.

Various mechanical systems can be utilized as a weight drive system to position the counterweight at a desired location along the support table 36. With reference to FIG. 2A-2D, one embodiment of a weight drive system employs a cable winch system 40A to position the counterweight 38 at a desired position along the support table 36. The cable winch system 40A obtains power from the motor/engine associated with the chassis and includes a control system that manages the winch so as to position the counterweight at the desired location along the table 36. Further, the support table 36 is a telescoping support table comprised of a first table portion and a second table portion that engage one another in telescoping manner. The length of the telescoping support table can be adjusted using a table motor 42 that moves the first table portion relative to the second table portion. The combination of elements that cooperate to apply a translational force to the first table portion are referred to as a table motor. In the illustrated embodiment, the table motor 42 includes a hydraulic piston. The pump and other related elements that are used to adjust the position of the first table portion are powered by the engine/motor associated with the chassis 22. Other forms of table motors are feasible. For instance, a table motor that employs a rack-and-pinion or a chain drive to name a few that are known to those skilled in the art are feasible. It should also be appreciated that, if the counterweight 38 is located on the first table portion, the counterweight 38 can be moved relative to the chassis using the hydraulic system 42 and without employing the cable winch system 40A. Generally, the telescoping support table 36 allows a greater range of lengths of piles to be accommodated by the pile driver 20, allows the profile of the pile driver 20 to be reduced to facilitate the movement of the pile driver 20 from one location to another, and allows the table to be shortened to prevent the table from engaging objects (such as previously driven piles) that could interfere with the rotation of the table. The cable winch system 40A includes an adjustable idler pulley system that engages the cable and can be adjusted depending on the length of the table. In one embodiment, the adjustment includes changing the position of a pulley to accommodate a change in the length of the table 36.

Figure 2A:
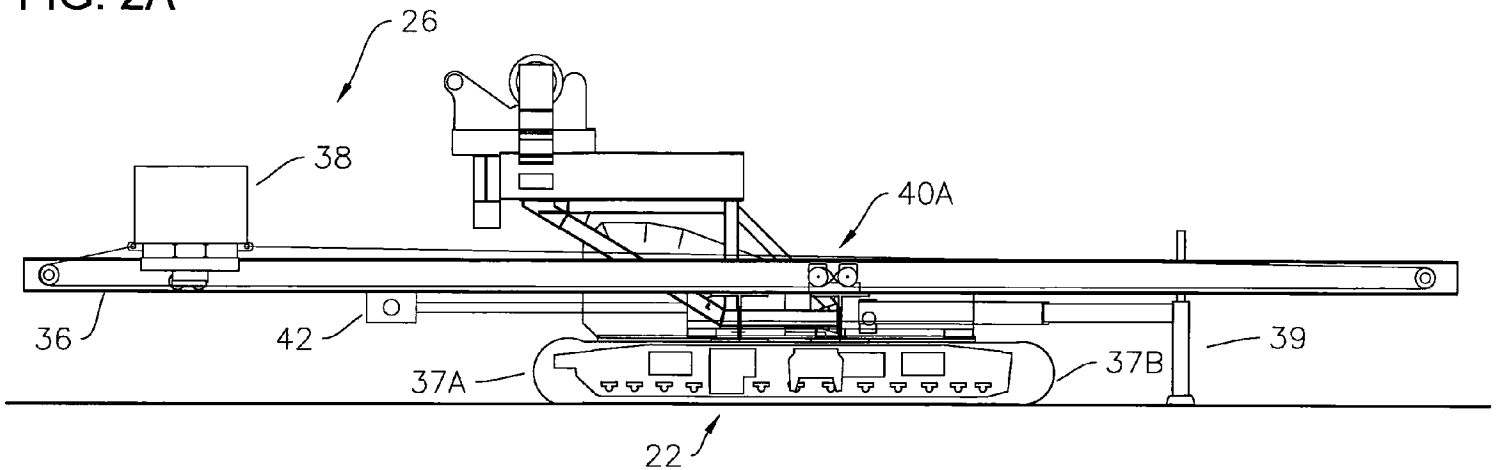
FIGS. 2A-2C illustrate a first embodiment of a movable counterweight system that compensates for the varying moments associated with the rotation of the lead and a pile resident in the lead.
Figure 2B:
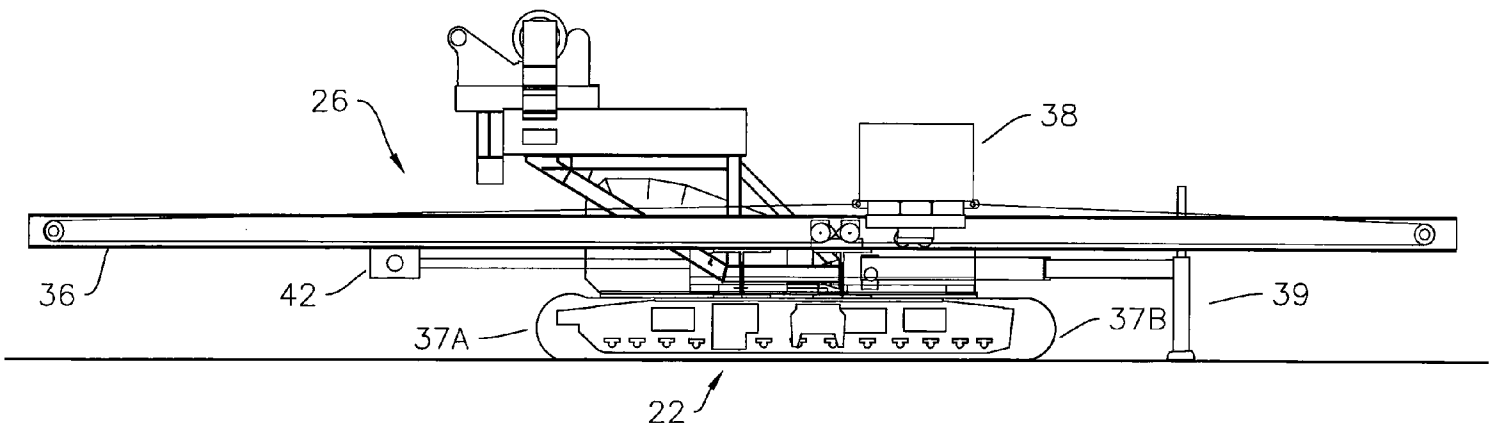
Figure 2C:
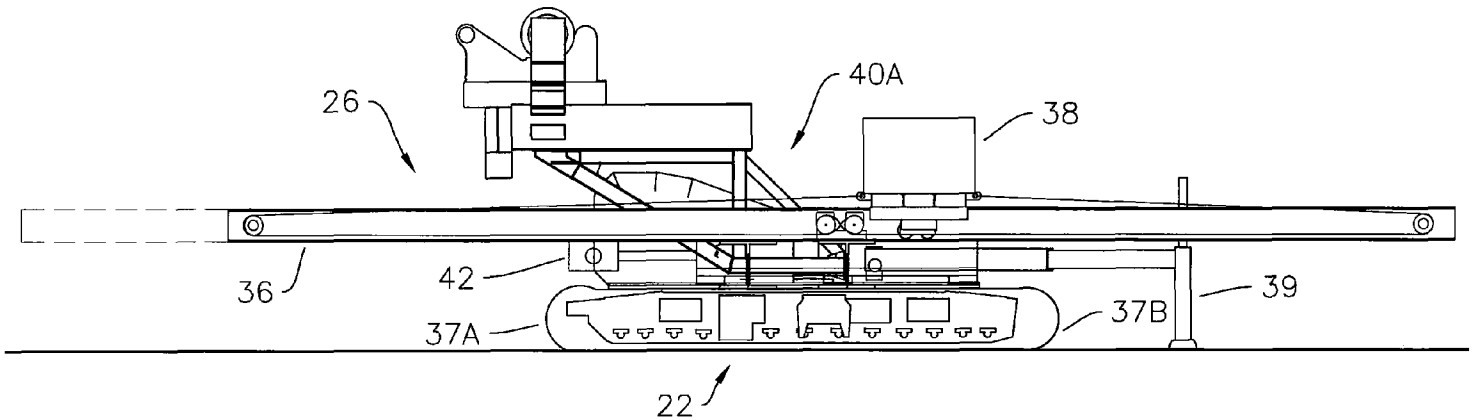
Figure 2D:
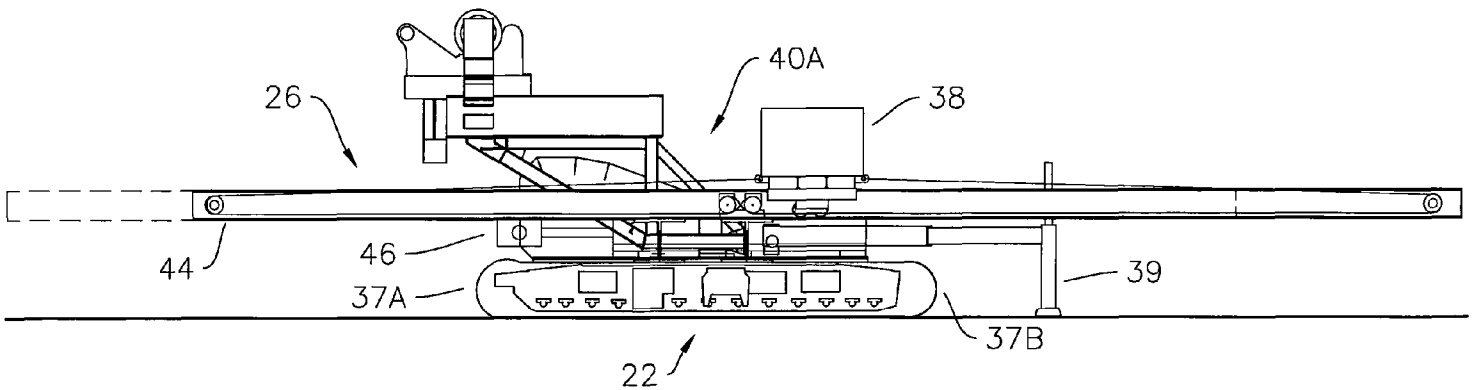
FIG. 2D illustrates the first embodiment of the movable counterweight system shown in FIGS. 2A-2C but with a movable, fixed length support table replacing the telescoping support table shown in FIGS. 2A-2C.

With reference to FIG. 2D, the telescoping support table 36 has been replaced with a fixed length support table 44 whose position can be adjusted with a table motor that includes a hydraulic piston 46. Support table 44 allows a greater range of lengths of piles to be accommodated by the pile driver and allows the position of the table to be adjusted so as to prevent the table from engaging objects (such as previously driven piles) that could interfere with the rotation of the table. In this case, the cable winch system does not need to employ an idler pulley system to accommodate changes in the length of the table.

Figure 3A:
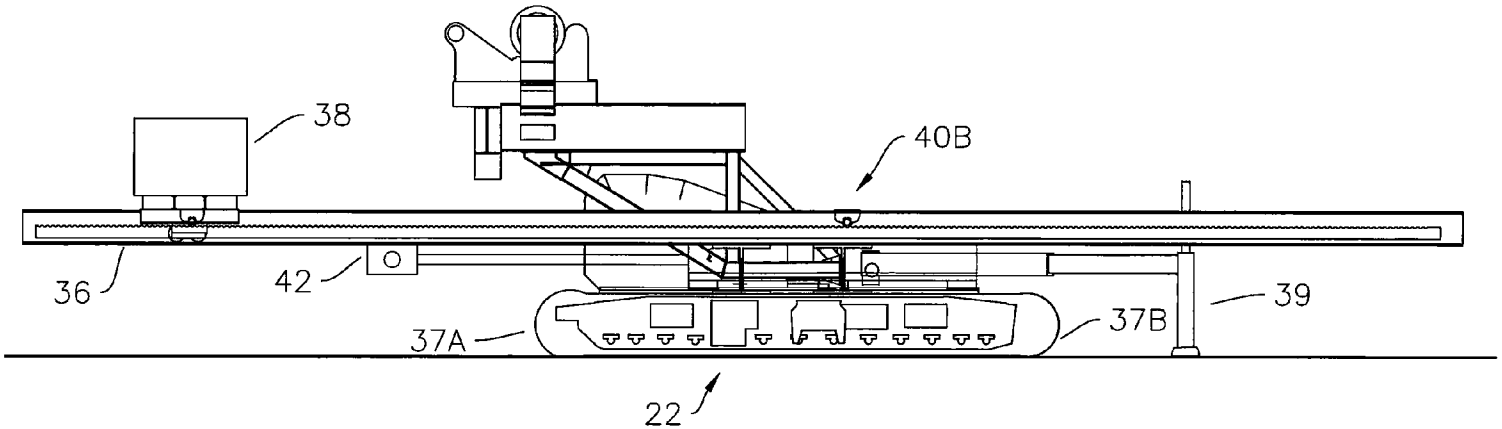
FIGS. 3A-3C illustrate a second embodiment of a movable counterweight system that compensates for the varying moments associated with the rotation of the lead and a pile resident in the lead.
Figure 3B:
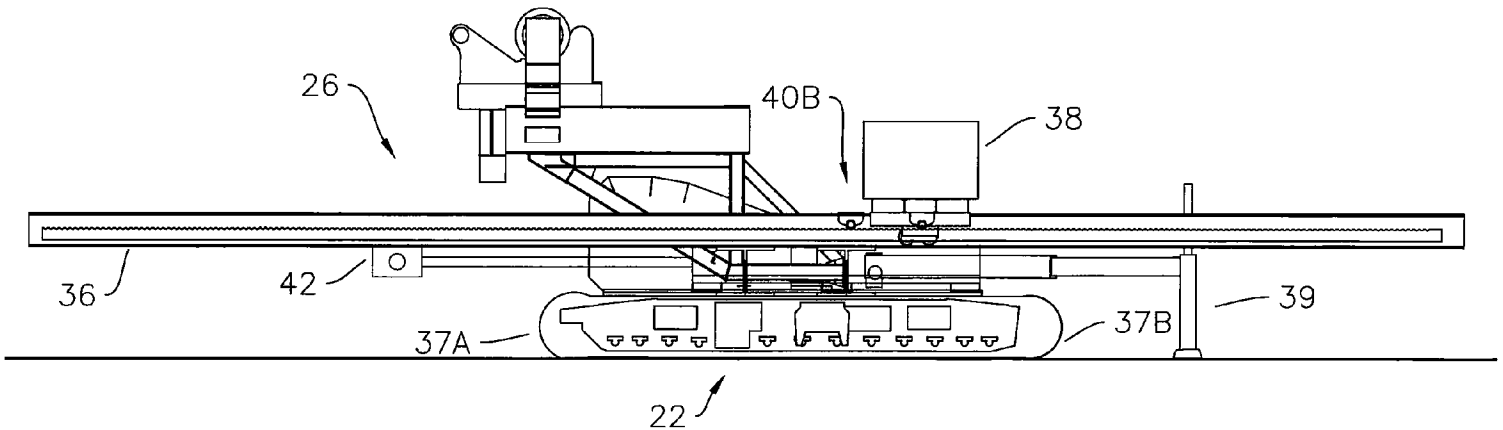
Figure 3C:
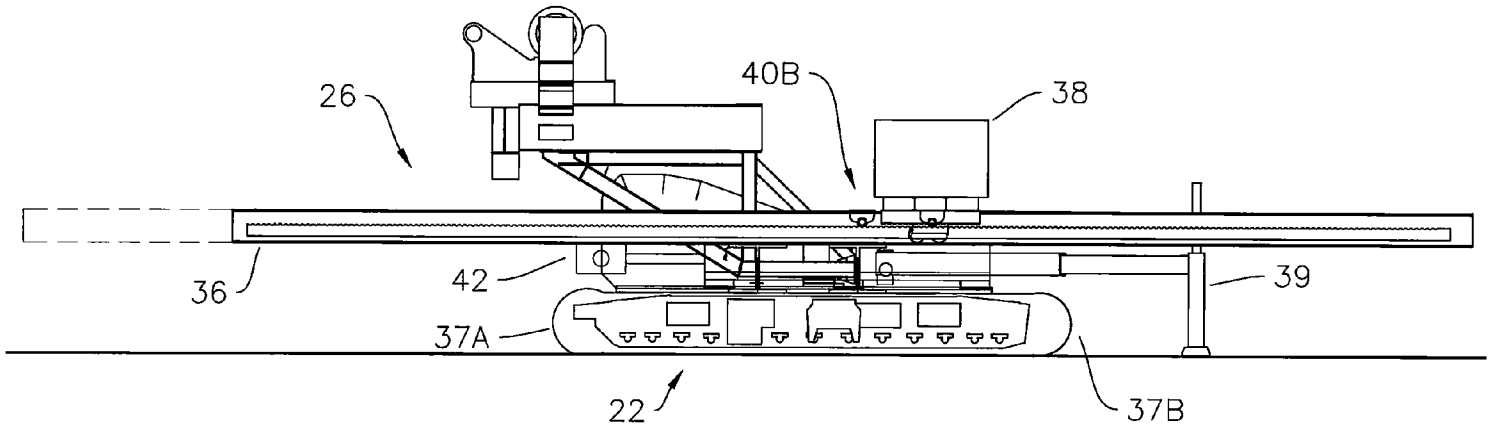
Figure 3D:
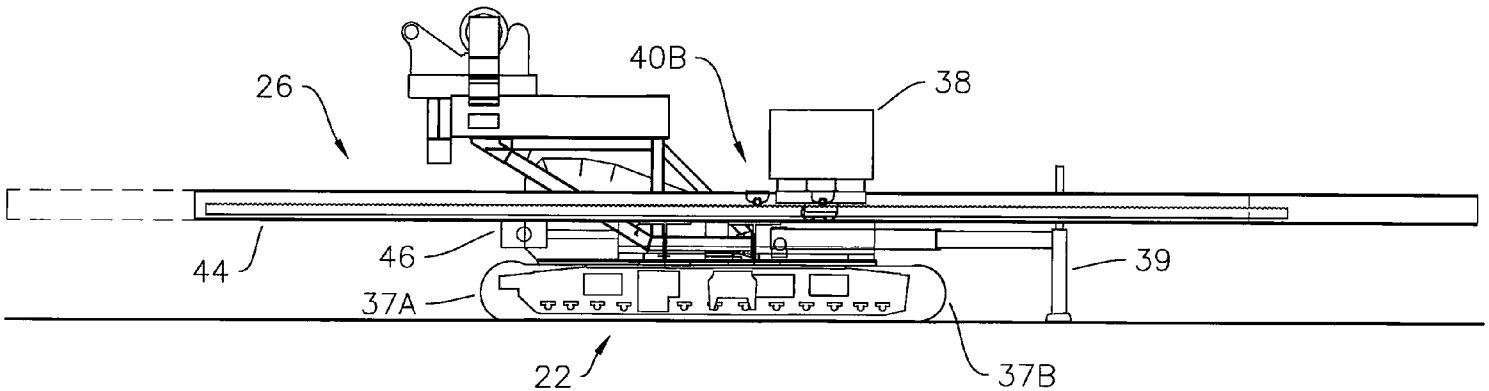
FIG. 3D illustrates the second embodiment of the movable counterweight system shown in FIGS. 3A-3C but with a movable, fixed length support table replacing the telescoping support table shown in FIGS. 3A-3C.

With reference to FIGS. 3A-3C, a weight drive system can also be realized with a rack-and-pinion system that operates to position the counterweight 38 at a desired position along the telescoping support table 36. The rack-and-pinion system 40B obtains power from the motor/engine and includes a control system that manages the pinion so as to position the counterweight at the desired location along the table 36. To accommodate the different lengths of the table, the rack is comprised of two racks, one associated with one portion of the table and the other associated with the other portion of the table. When the table is relatively short, the two racks overlap one another and the pinion engages both racks over the range in which the two racks overlap. When the table is lengthened, the overlap of the two racks is reduced and the pinion engages both of the racks over a lesser range. With reference to FIG. 3D, the telescoping support table 36 has been replaced with a fixed length support table 44 whose position can be adjusted with a table motor that includes the hydraulic piston 46. In this case, the rack-and-pinion system does not need to employ two racks, as with the telescoping support table, a single rack is sufficient.

Figure 4A:
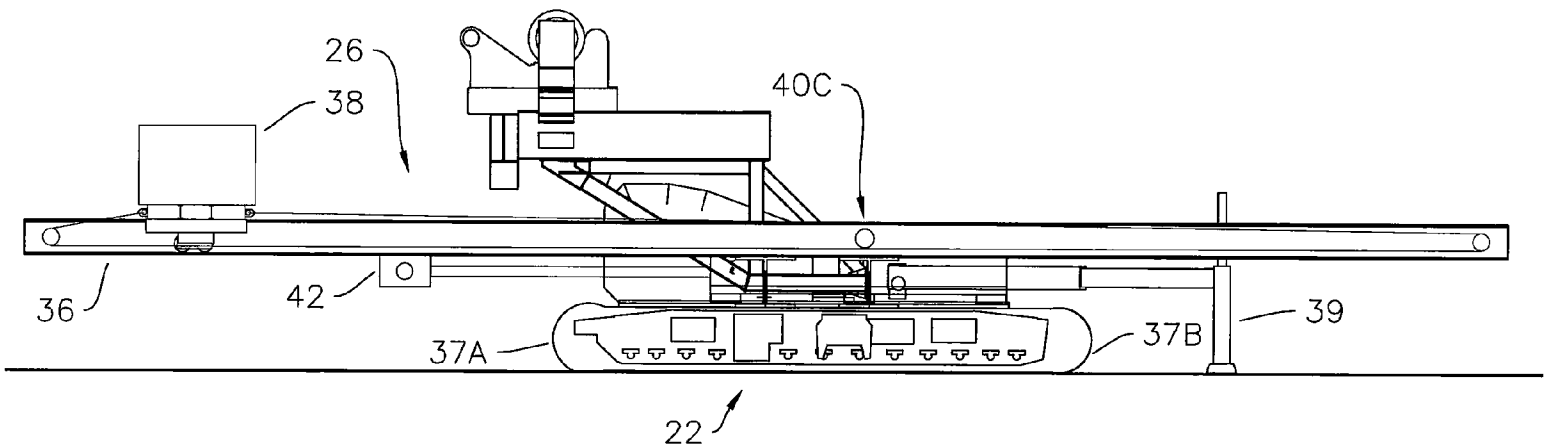
FIGS. 4A-4C illustrate a third embodiment of a movable counterweight system that compensates for the varying moments associated with the rotation of the lead and a pile resident in the lead.
Figure 4B:
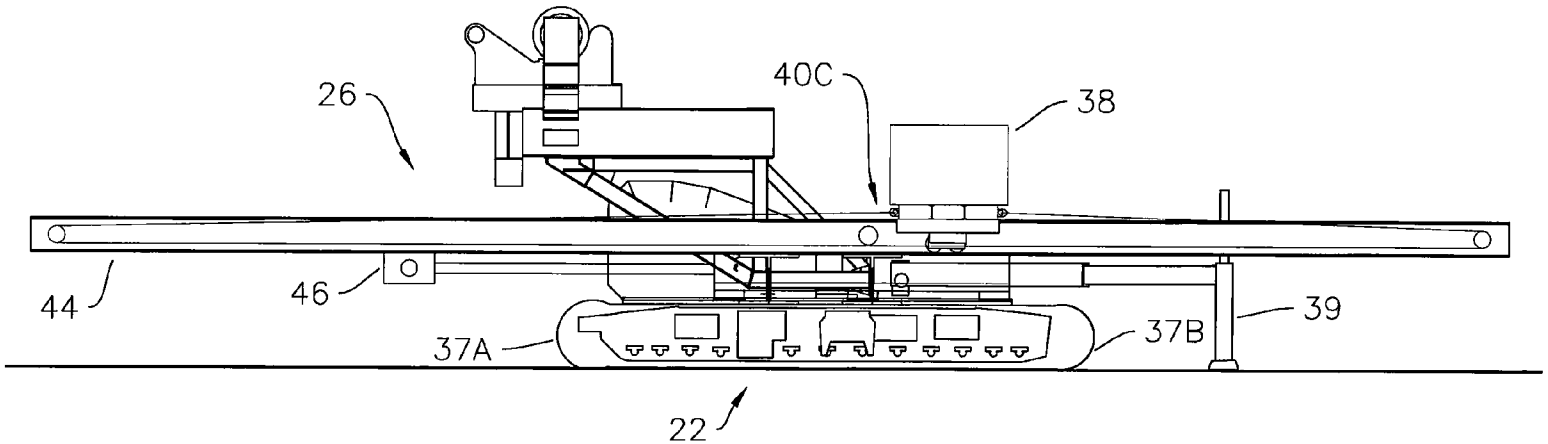
Figure 4C:
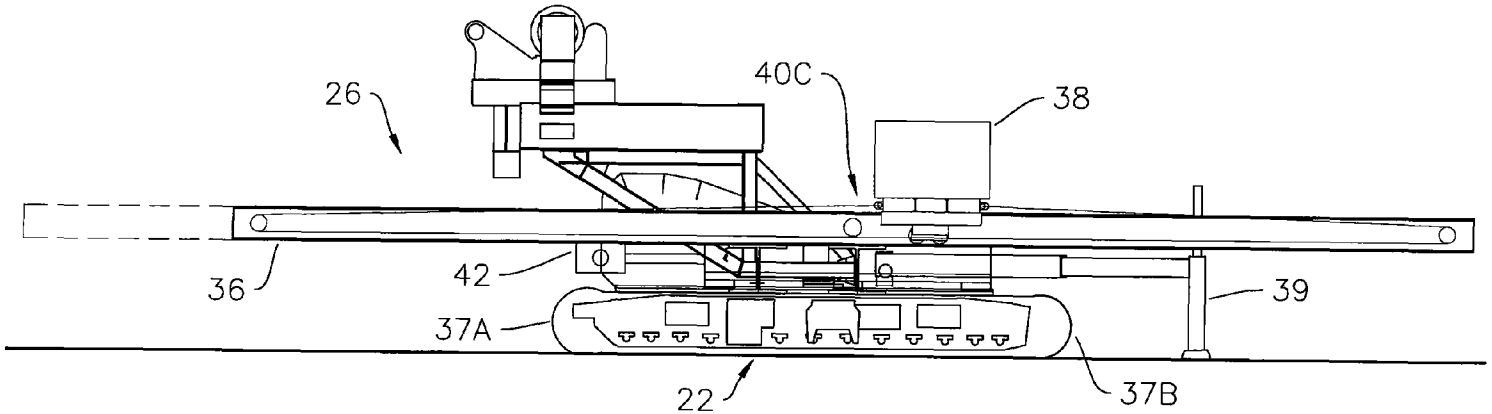
Figure 4D:
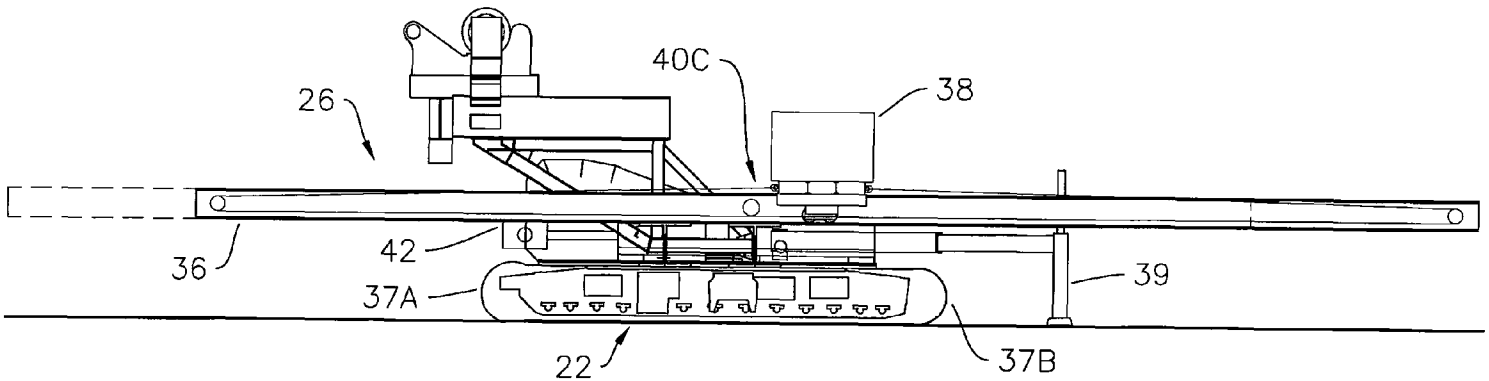
FIG. 4D illustrates the third embodiment of the movable counterweight system shown in FIGS. 4A-4C but with a movable, fixed length support table replacing the telescoping support table shown in FIGS. 4A-4C.

With reference to FIGS. 4A-4C, a weight drive system can also be realized with a chain drive system that operates to position the counterweight 38 at a desired position along the telescoping support table 36. The chain drive system 40C obtains power from the motor/engine and includes a control system that manages the gear or gears so as to position the counterweight at the desired location along the table 36. The chain drive system 40C includes an adjustable gear that engages the chain and whose position is adjusted depending on the length of the table. With reference to FIG. 4D, the telescoping support table 36 has been replaced with a fixed length support table 44 whose position can be adjusted with a table motor that includes the hydraulic piston 46. In this case, the chain drive system does not need to employ an idler gear to accommodate changes in the length of the table.

Figure 5A:
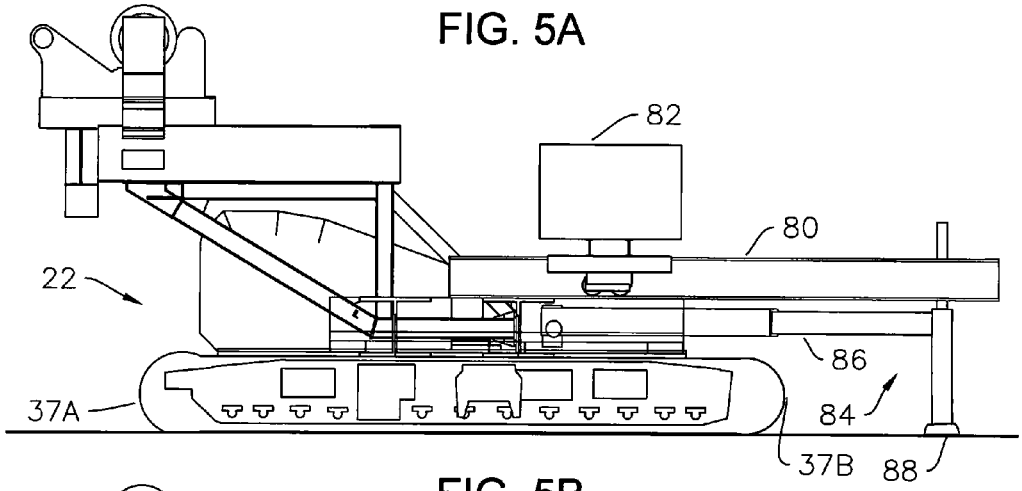
FIGS. 5A-5C illustrate a fourth embodiment of a movable counterweight system that compensates for the varying moments associated with the rotation of the lead and a pile resident in the lead.
Figure 5B:
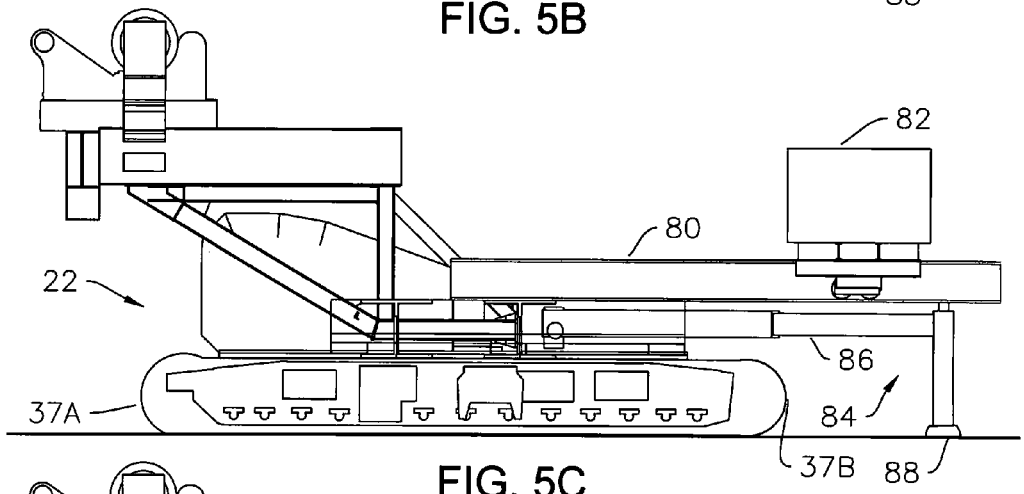
Figure 5C:
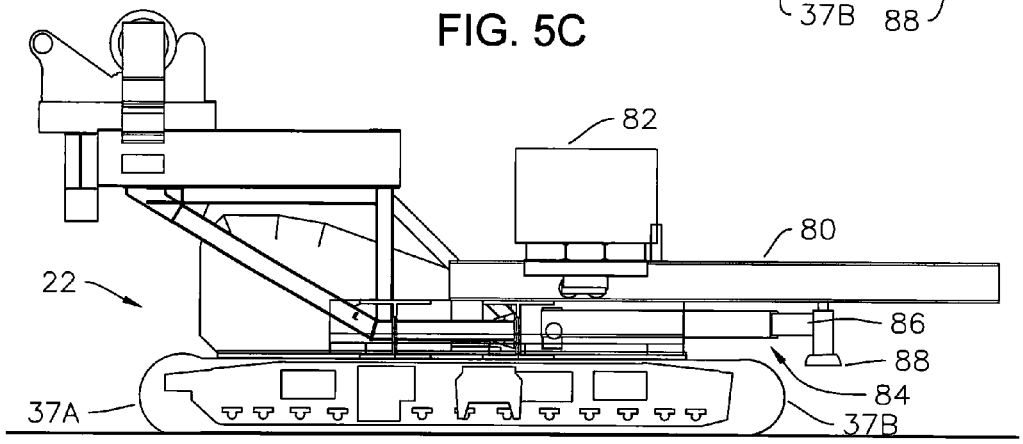
Figure 6A:
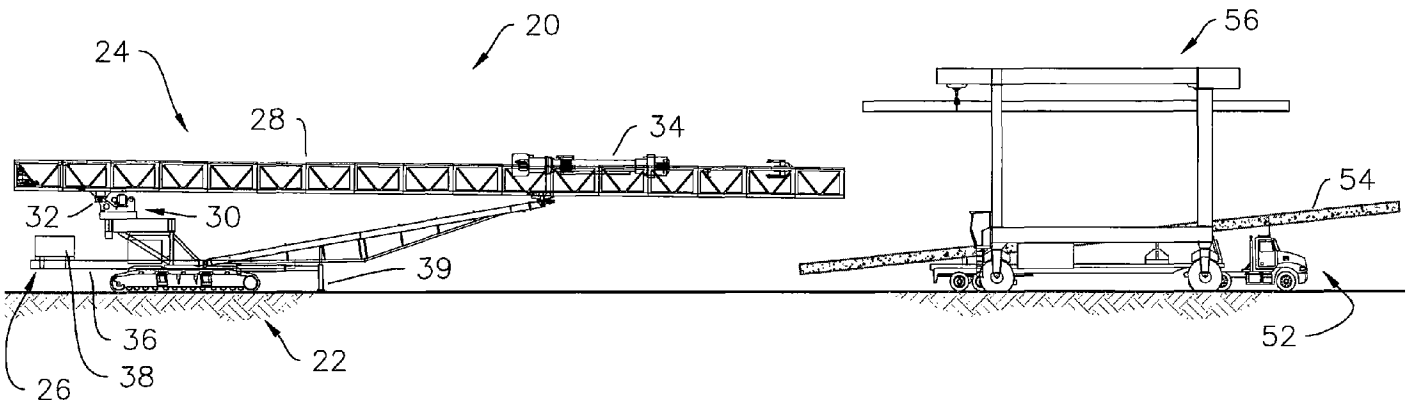
FIGS. 6A-6H illustrate the embodiment of the pile driver illustrated in FIGS. 1A-1H and a second embodiment of a method that utilizes the pile driver in establishing a pile in the earth.
Figure 6B:
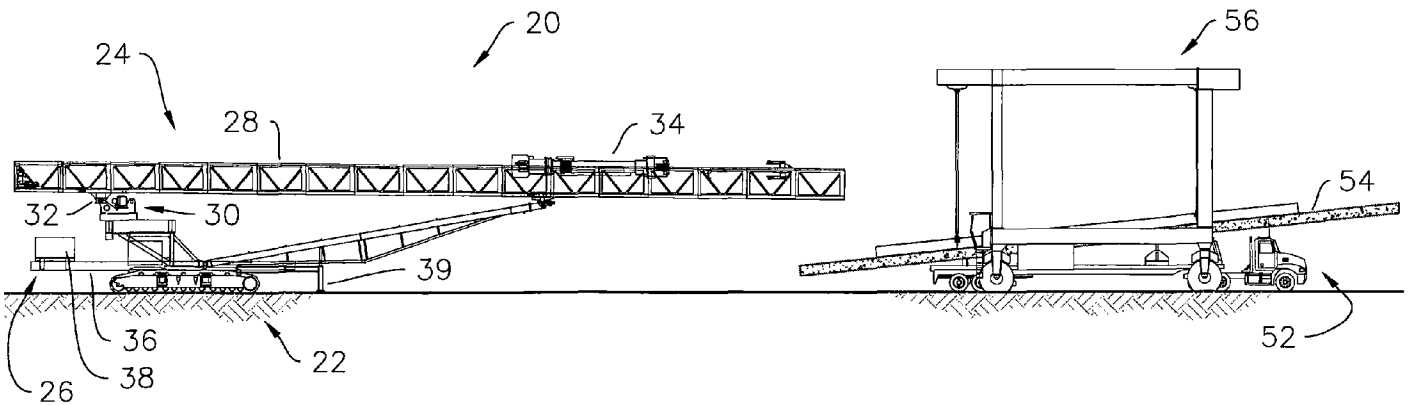
Figure 6C:
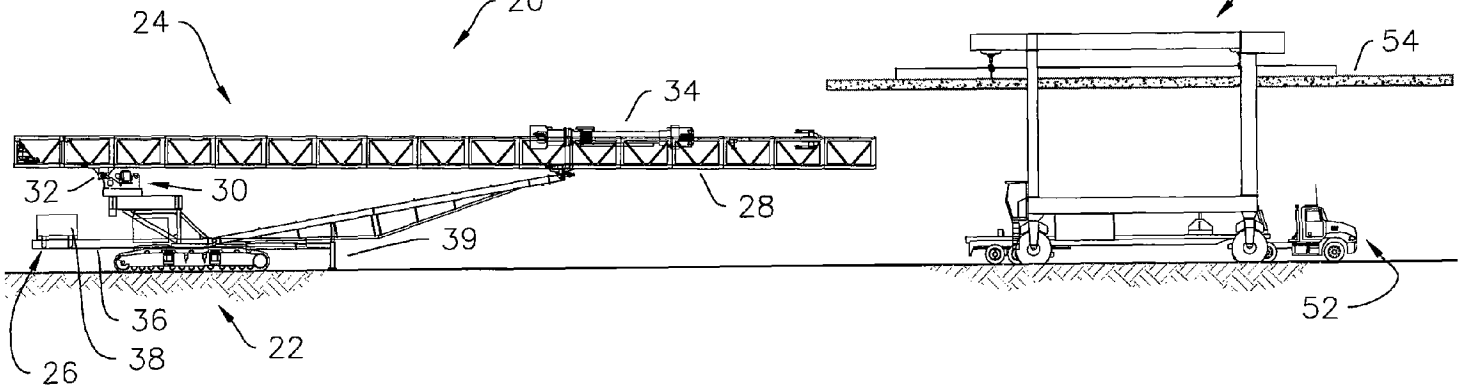
Figure 6D:
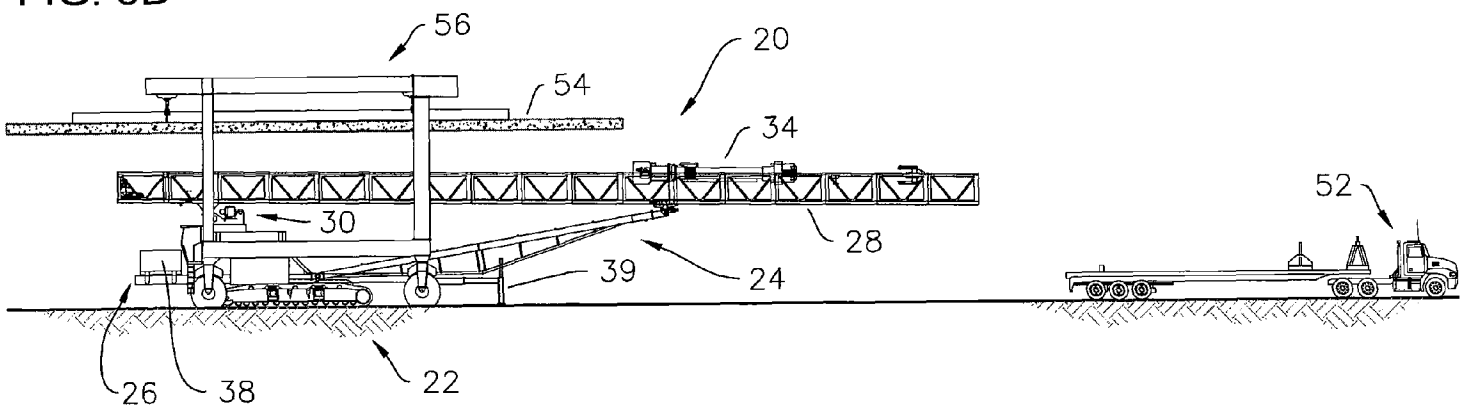
Figure 6E:
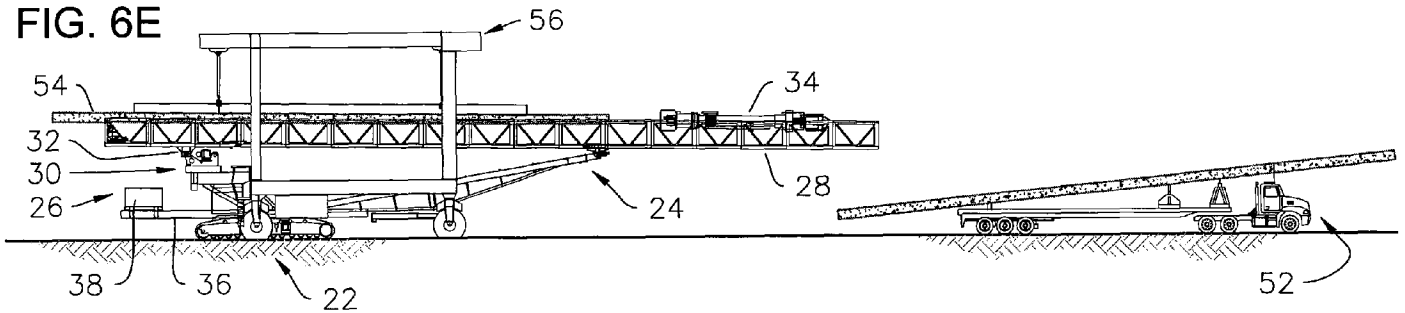
Figure 6F:
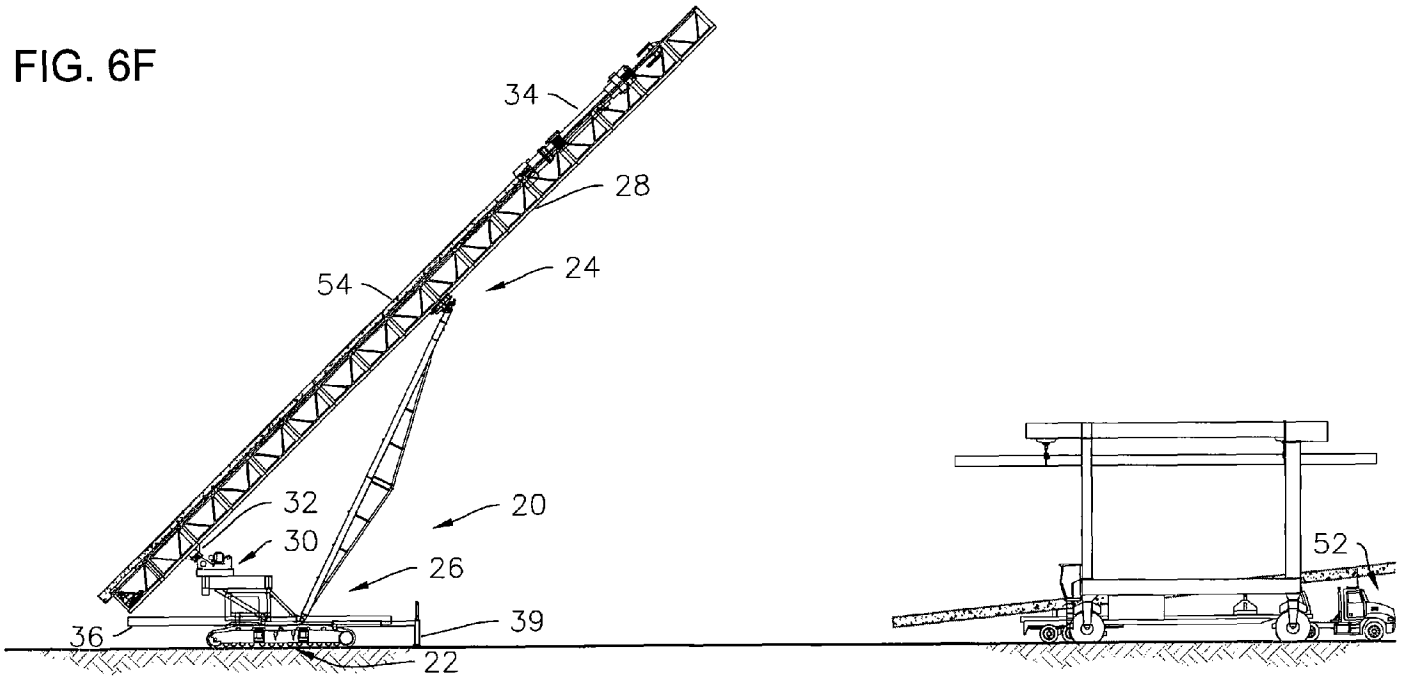
Figure 6G:
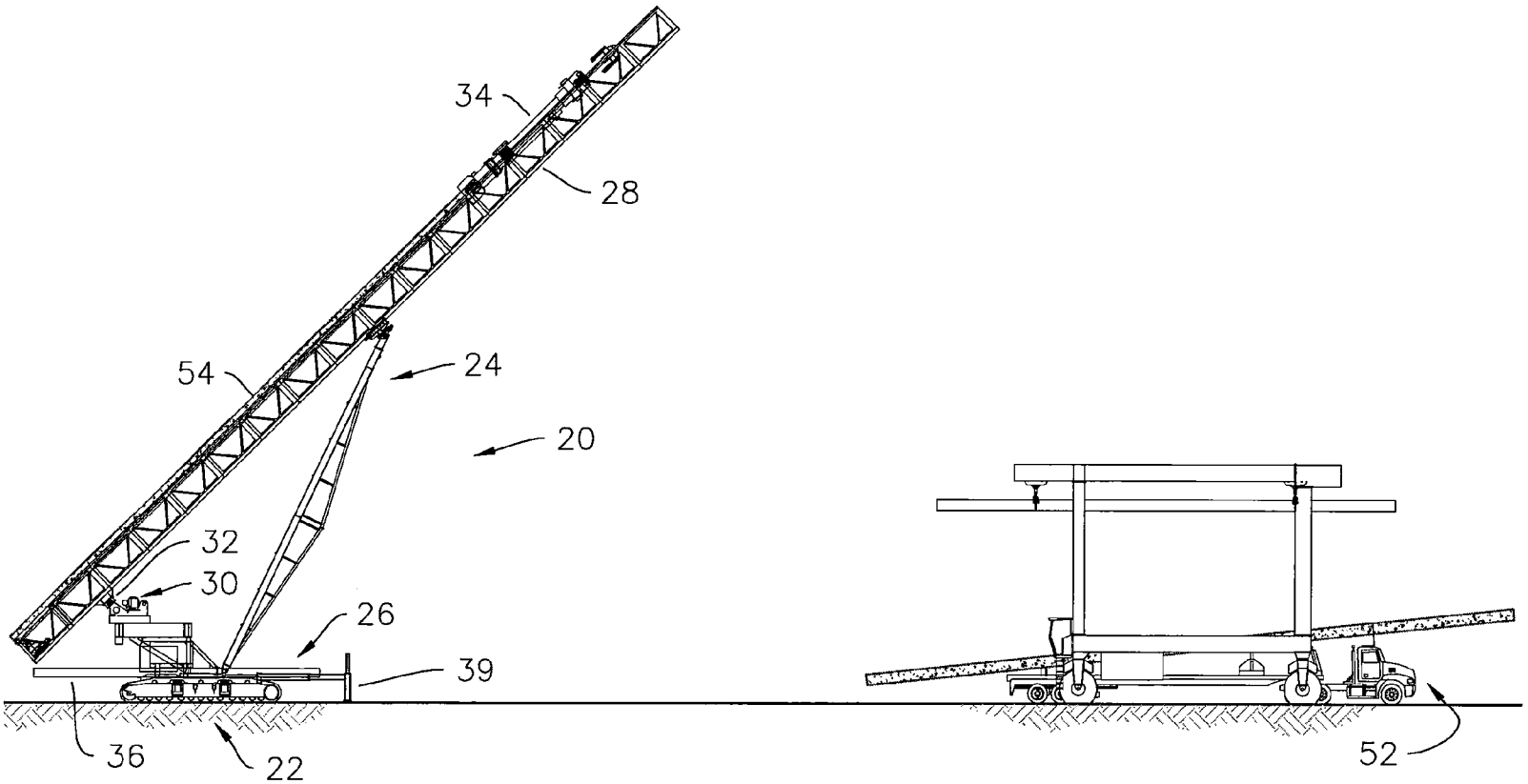
Figure 6H:
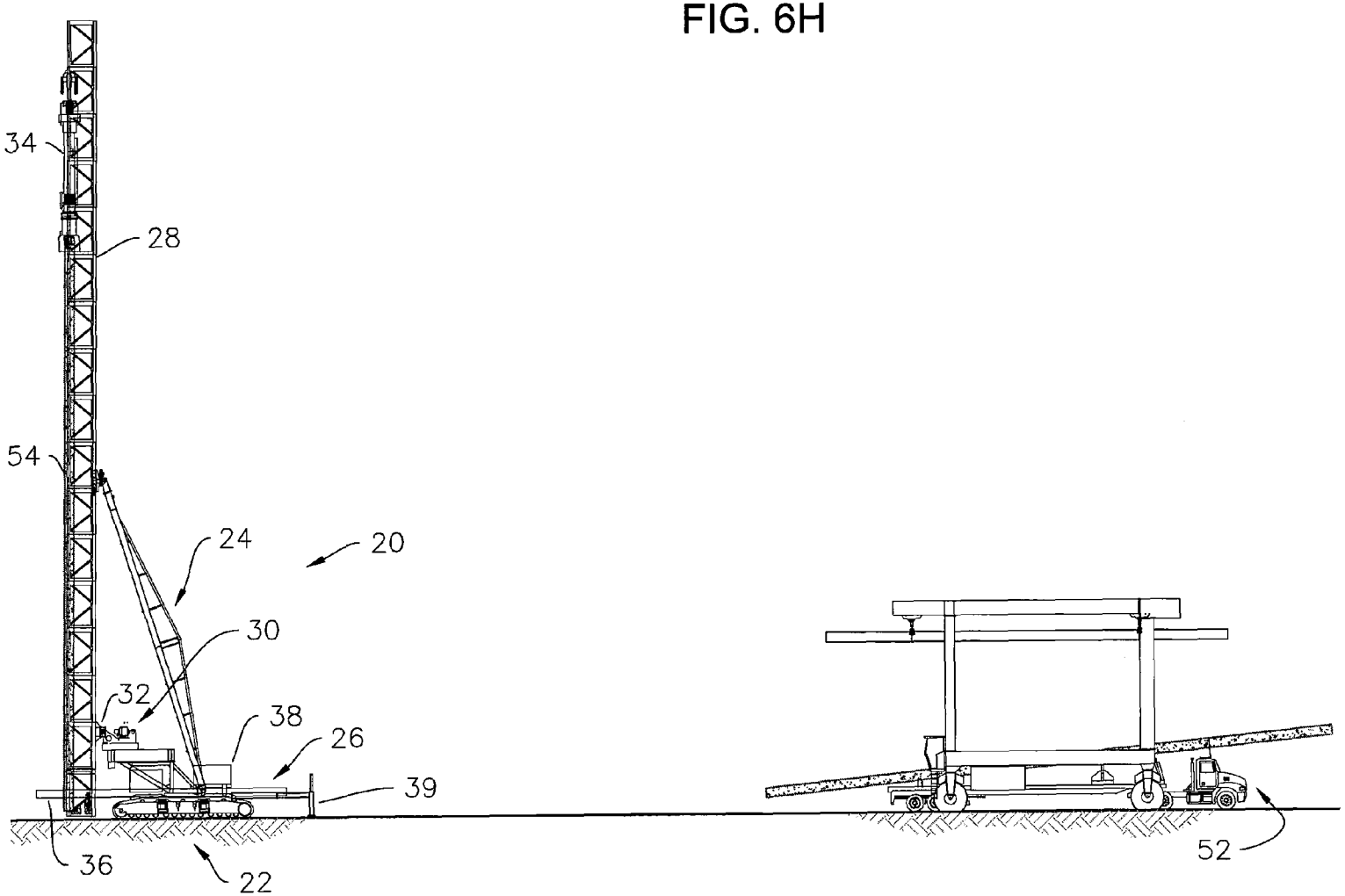
Figure 7A:
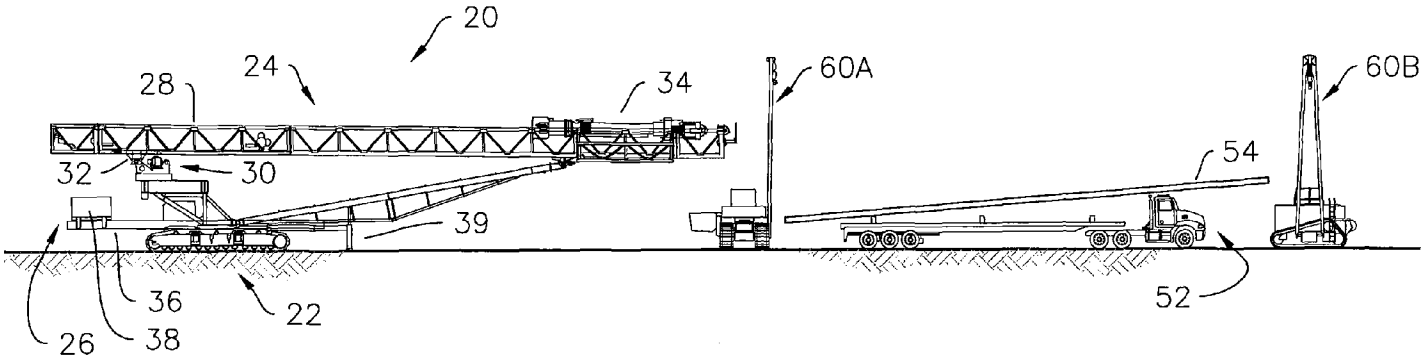
FIGS. 7A-7G illustrate the embodiment of the pile driver illustrated in FIGS. 1A-1H and a third embodiment of a method that utilizes the pile driver in establishing a pile in the earth.
Figure 7B:
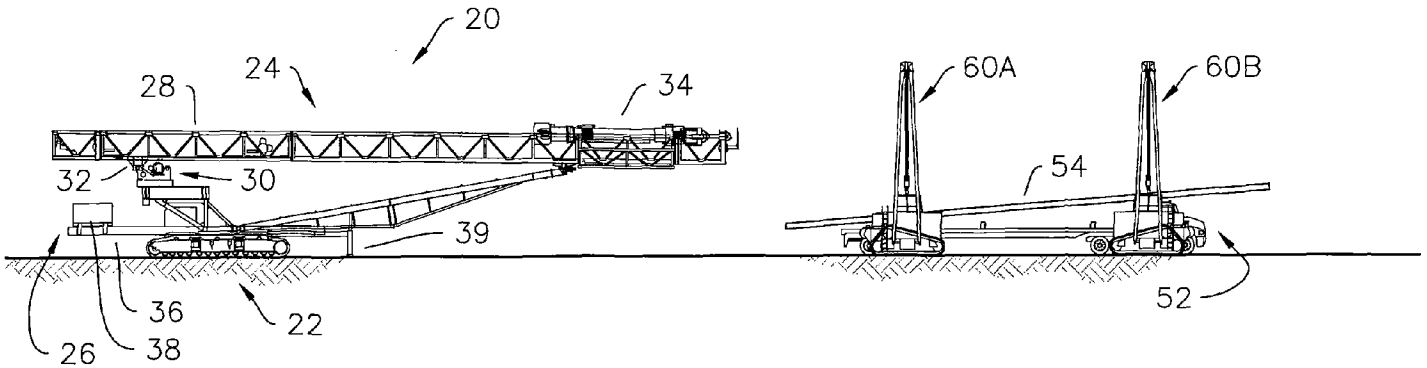
Figure 7C:
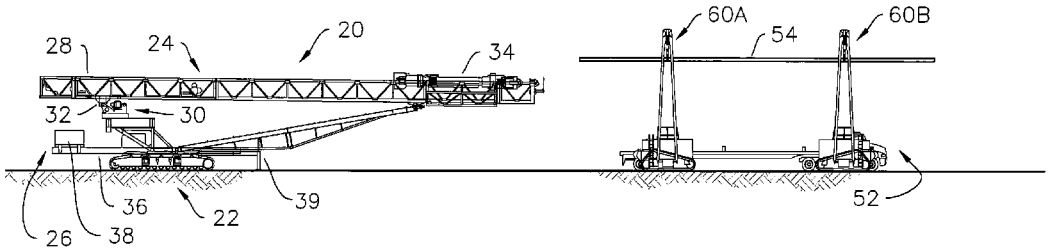
Figure 7D:
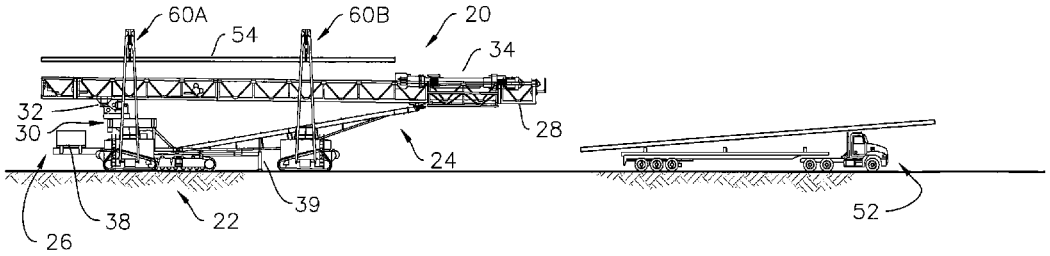
Figure 7E:
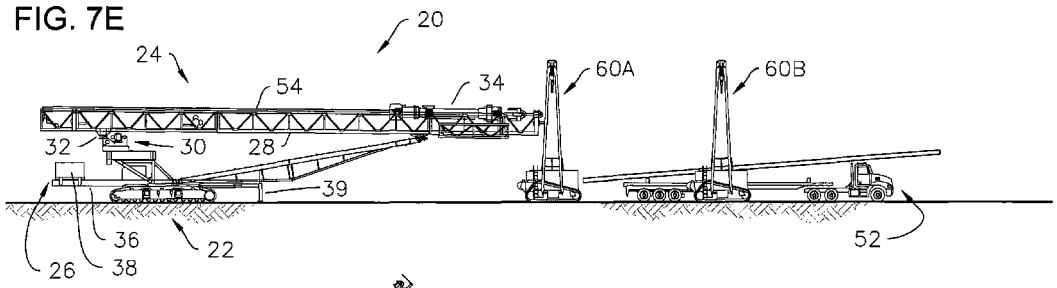
Figure 7F:
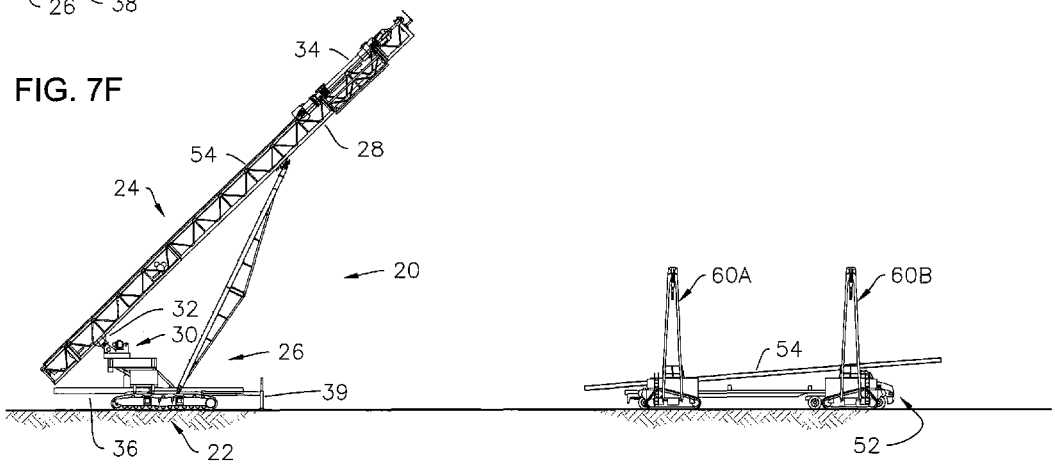
Figure 7G:
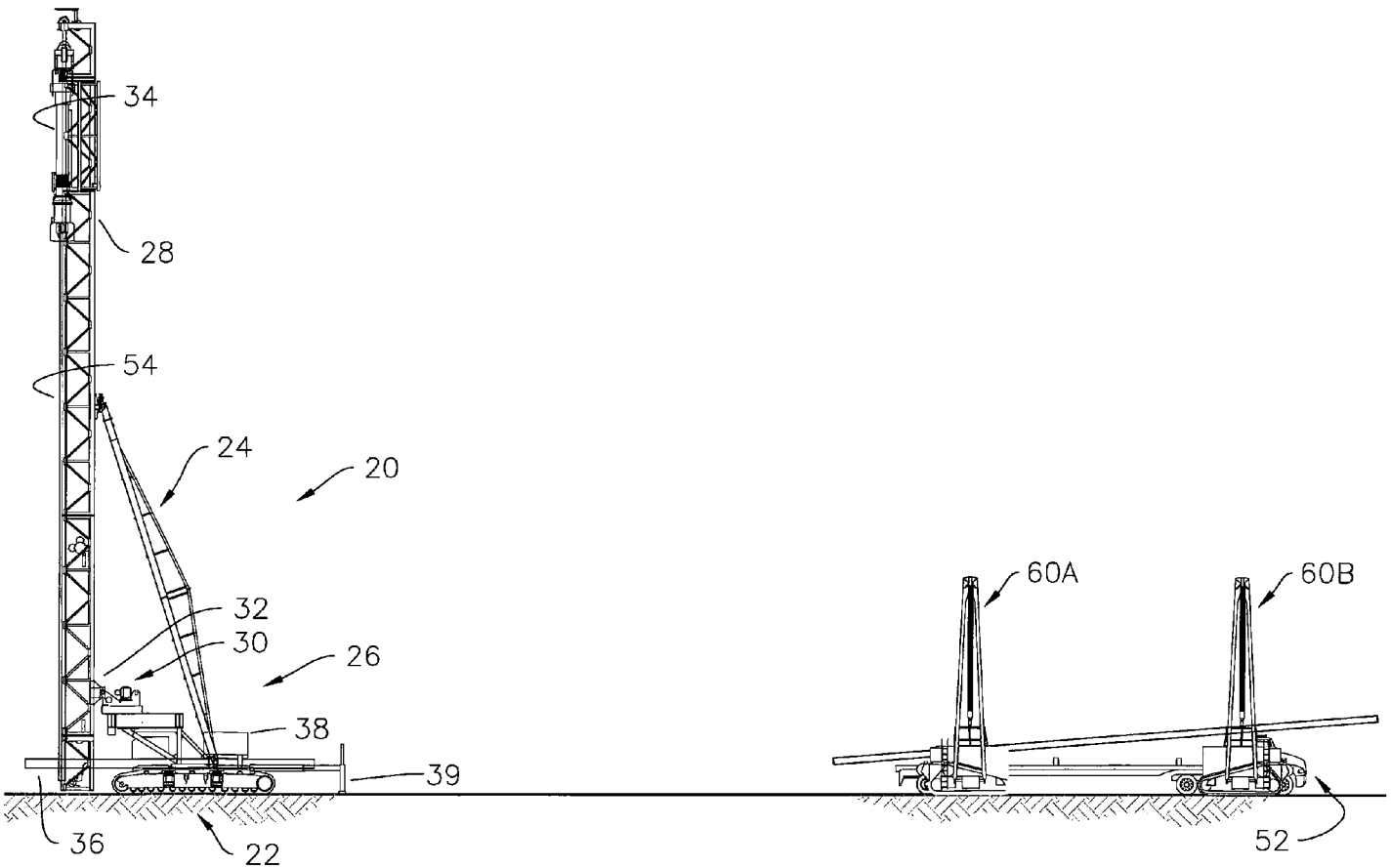

With reference to FIGS. 5A-5C, another embodiment of a movable counterweight system 26 that is particularly applicable to embodiments of the pile driver 20 in which the turntable associated with the chassis has limited rotational capability (i.e., is capable of rotating substantially less than 180°) or a chassis that does not utilize a turntable. The system is comprised of a support table 80, a counterweight 82, a weight drive system for adjusting the position of counterweight on the support table (e.g., cable-winch, rack-and-pinion, or chain drive system), and an adjustable outrigger 84. The table 80 extends from a first terminal end to a second terminal end. However, only the second terminal end is located beyond the outer boundary of the chassis. The adjustable outrigger 84 includes an arm 86 whose length can be hydraulically adjusted and foot 88 that is capable of being deployed so as to engage the ground. With reference to FIG. 5A, in anticipation of loading a pile into the lead, the lead 28 is placed in a substantially horizontal position (see, e.g., FIG. 1A), the length of the arm 86 is adjusted, and the foot 88 is deployed so as to engage the ground. Typically, the counterweight 82 is positioned nearer the end of the table 80 that is farther from the foot 86, as shown in FIG. 5A. However, the counterweight 82 can also be positioned closer to the end of the table that is nearer the foot. The pile 54 is then loaded into the substantially horizontally positioned lead (see, e.g., FIG. 1E). At this point, the engagement of the ground with the foot 86 provides a counter moment to the moment associated with the pile 54 in the substantially horizontal lead 28, thereby preventing the pile driver from tipping. If, during rotation of the lead 28 and associated pile 54 (see, e.g., FIG. 1F), the counterweight 82 is not already positioned adjacent to the end of the table 80 that is nearer the foot 86, the counterweight 82 is moved towards that the end of the table 80 nearer the foot to provide a counter moment to the moment associated with the rotating lead 28 and pile 54. If, prior to rotation of the lead 28 and associated pile 54, the counterweight 82 is already positioned adjacent to the end of the table 80 that is nearer the foot 86 then no or little repositioning of the counterweight 82 is needed during the rotation to provide the needed counter-moment.

It should be appreciated that a support table of fixed length and that cannot be moved or telescoped is also feasible. Additionally, it should be appreciated that other weight drive systems that employ cables, pulleys, gears, chains, hydraulics, pneumatic cylinders etc. and combinations of such elements are also feasible for moving a counterweight along a support table. Also feasible is a system in which a clutch is employed so that the driving element of whatever system is used to adjust the position of the counterweight (e.g., the motor that drives the winch, the pinion, or drive gear in the illustrated embodiments) can also be switched to drive a mechanical system that adjusts the length of a telescoping support table or adjusts the position of a fixed length table The positioning of the counterweight 38 at the appropriate position or within a range of positions along the support table 36 (or relative to the chassis 22) to counteract the moment resulting from the association of a pile with the lead is preferably done in an automatic fashion in which a computer is initially provided with the conditions that are relevant to determining the moment that will be produced upon associating a particular pile with the lead and the desired end position for the lead and the pile retained by the lead. The conditions can be provided to the computer by one or more other computers, one or more sensors, via an operator, or from a combination of such sources. After the computer is provided with this data, the computer then causes: (a) if needed, the counterweight 38 to be positioned for the subsequent loading of the pile into the lead, (b) the lead and the particular pile being held by the lead to rotate from a substantially horizontal position towards the desired vertical position for driving the pile into the earth, (c) during the rotation, one or more sensors that provide data relevant to determining the appropriate position for the counterweight 38 to be monitored, and (c) the position of the counterweight 38 to be adjusted as needed during the rotation. Other approaches to positioning the counterweight 38 along the support table 36 are feasible. For instance, a more operator intensive approach involves providing an operator with a table and/or graph system that allows the operator to determine the appropriate position or range of positions for the counterweight during rotation of the lead and a particular pile held by the lead between two defined rotational positions. In this approach, the table and/or graph would provide the operator with the position or range of positions for the counterweight 38 that will counterbalance a particular pile when the pile is received in the substantially horizontally positioned lead. Typically, this position will accommodate some rotation of the lead and pile but not be appropriate to accommodate rotation of the lead and resident pile to the final position needed for driving the pile. In this case, the operator defines a stop rotation point at which a new position or range of positions are determined for the counterweight 38 to counter the moments associated with a further range of rotation of the lead and resident pile. This process is repeated until the lead and resident pile reach the desired position. Other approaches involving greater degrees of automation and lesser degrees of operator interaction are feasible.

Figure 1B:
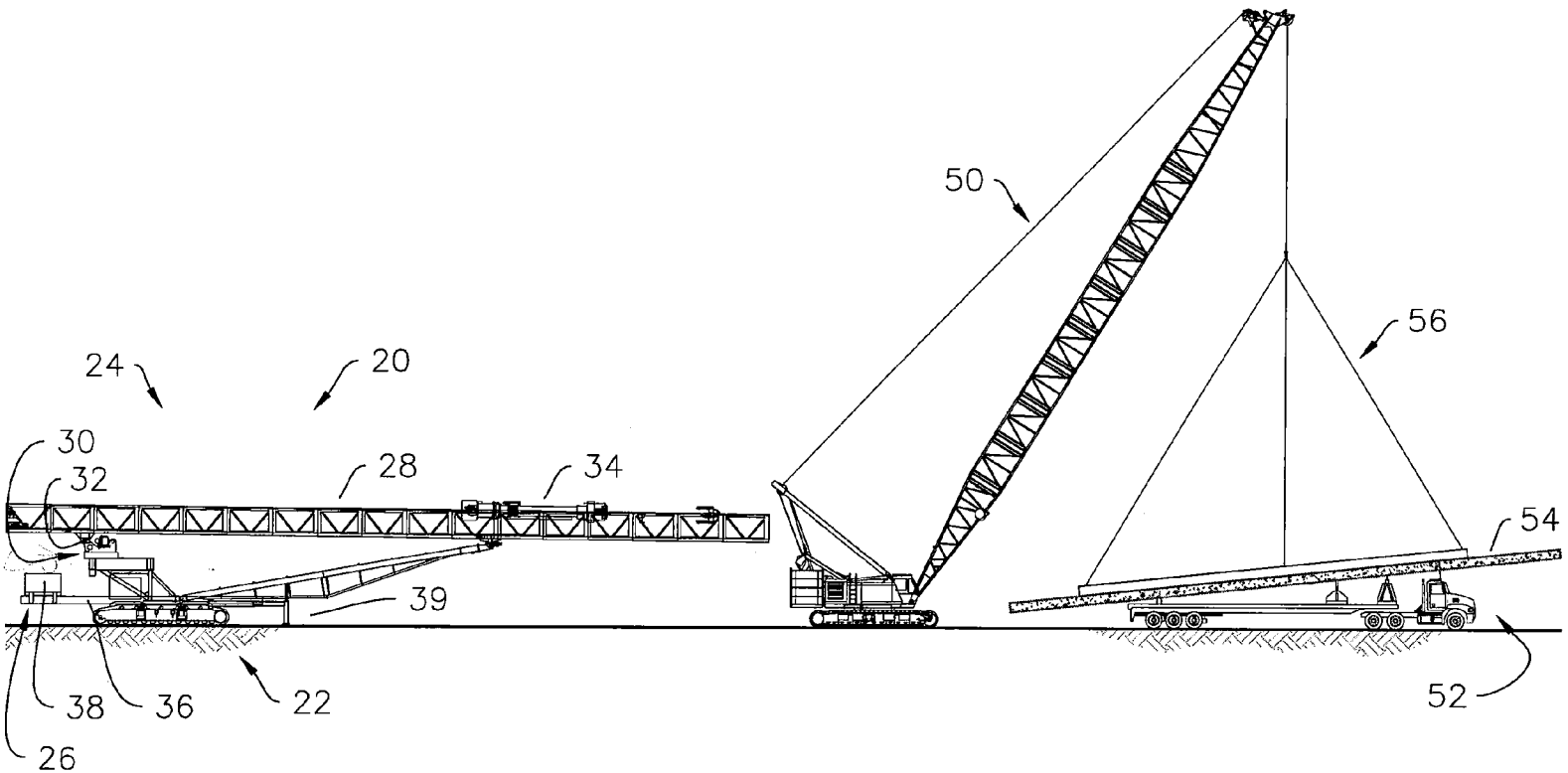
Figure 1C:
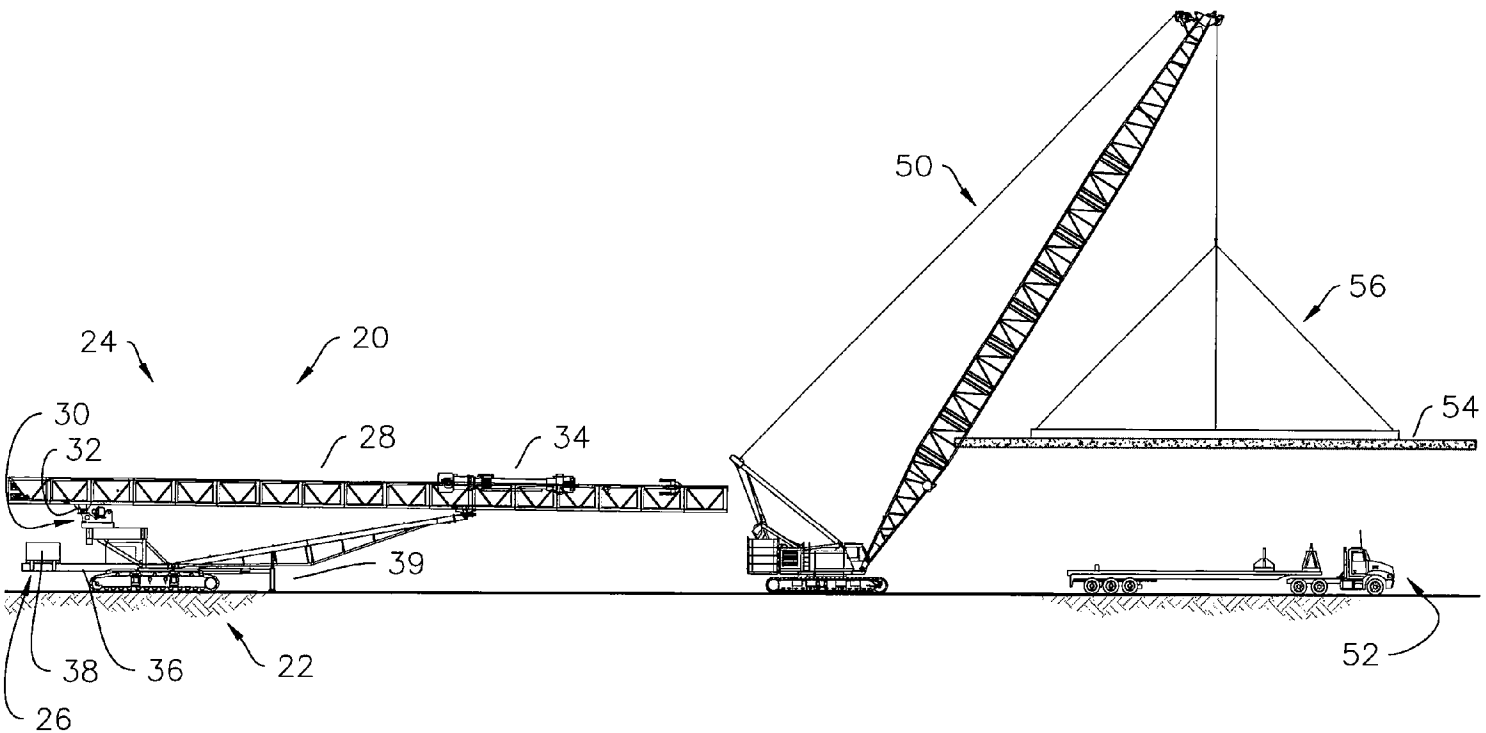
Figure 1D:
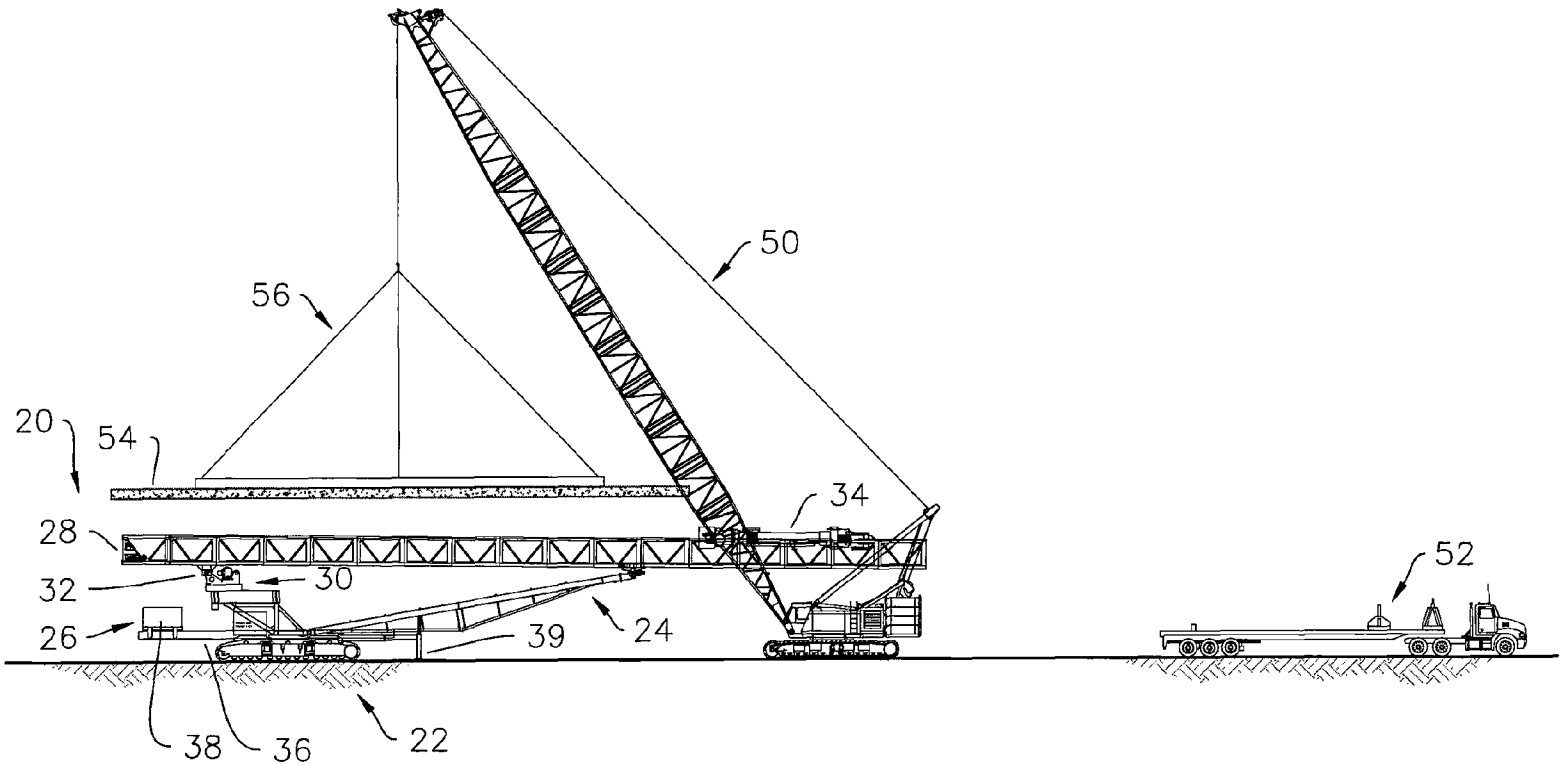
Figure 1E:
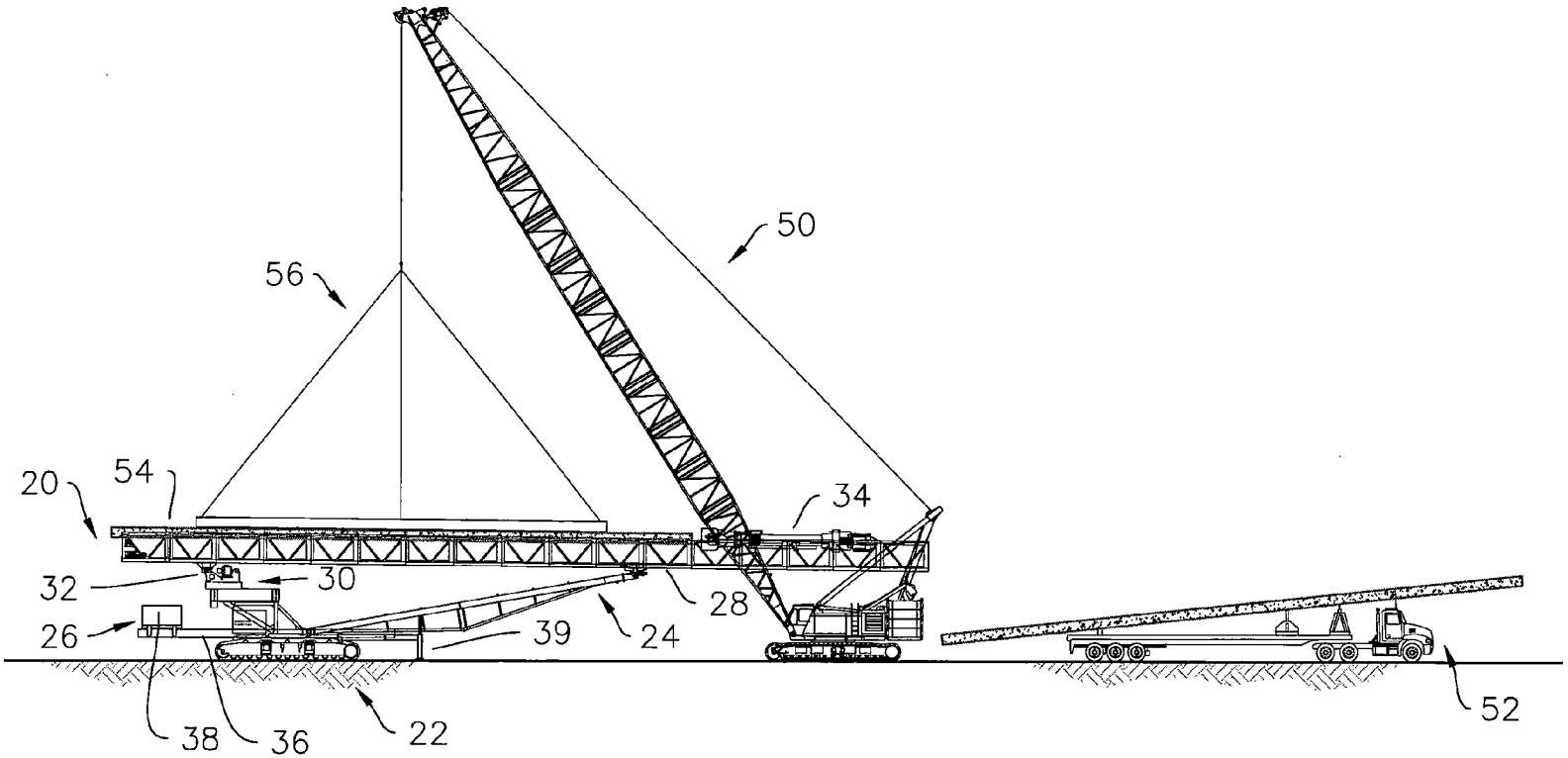

With reference to FIGS. 1A-1H, an embodiment of a method of using the pile driver 20 to drive a pile is described. Initially, with reference to FIG. 1A, the pile driver 20, a crawler crane 50, and a truck 52 with a pile 54 are at a construction site. The crane 50 is equipped with a lifting beam rig 56 that facilitates the lifting of the pile 54 by providing the ability to engage the pile 54 at several points along the length of the pile 54 so as to cradle the pile during movement from the truck 52 to the pile driver 20. As such, the pile 54 is less likely to be damaged or break during movement between the truck 52 and the pile driver 20. Typically, the truck 52 has brought the pile 54 from a prefabrication site to the construction site. However, it should be appreciated that other vehicles, such as trains, may also be used to transport a pile to a construction site. Further, on-site fabrication of the pile 54 is also feasible and the pile may be stockpiled on the ground or on a rack. With reference to FIG. 1B, the crane 50 is operated so that the lifting beam rig 56 is positioned to engage and is engaged to the pile 54 on the truck 52. As shown in FIG. 1C, the crane 50 operates to lift the pile 54 away from the truck with the pile 54 remaining in a substantially horizontal orientation. With reference to FIG. 1D, the crane 50 then moves the pile 54 into position for loading into the lead 28 of the pile driver 20, which is in a substantially horizontal orientation that substantially parallels the horizontal orientation of the pile 54. It should be appreciated that, while the lead 28 of the pile drive 20 has been shown in a substantially horizontal orientation in FIGS. 1A-1C, it is not necessary to place the lead 28 in this orientation until shortly before the point at which the pile 54 is to be loaded into the lead. Further, the counterweight 38 has been positioned so as to counteract the moment that is expected to be generated when the pile 54 is subsequently placed in the lead 28. The outrigger 39 has also been deployed so as to counteract the moment associated with the loading of the pile into the lead 28. In this regard, the longitudinal axis of the pile 54 is substantially parallel to but separated from the longitudinal axis of the lead 28 at a point shortly before the pile engages the lead. With reference to FIG. 1E, the crane 50 loads the pile 54 into the lead 28 of the pile driver 20. It should be appreciated that, while FIGS. 1A-1E show the lead 28 as being in a horizontal orientation and FIGS. 1C-1D show the pile 54 as being transported in a horizontal orientation, such absolute horizontal orientations are not required. Additionally, the time needed to move the pile from the truck to the lead and load the pile into the lead can be reduced in many cases by placing the lead at an angle that is substantially the same as the angle of the pile on the truck. In many cases, the angle of the pile 54 on the truck 52 or other conveyance is determined by the length of the pile 54, the capabilities and/or dimensions of the truck or other conveyance, and the need to transport the pile 54 under overpasses and the like. Consequently, the substantially horizontal orientation of the pile 54 during transport can be between substantially parallel to the horizontal and at an angle to the horizontal such that one end of the pile 54 clears any overpasses or other overhead obstacle and the other end of the pile avoids engaging the ground or other underlying surface over which the pile is being transported.

Figure 1F:
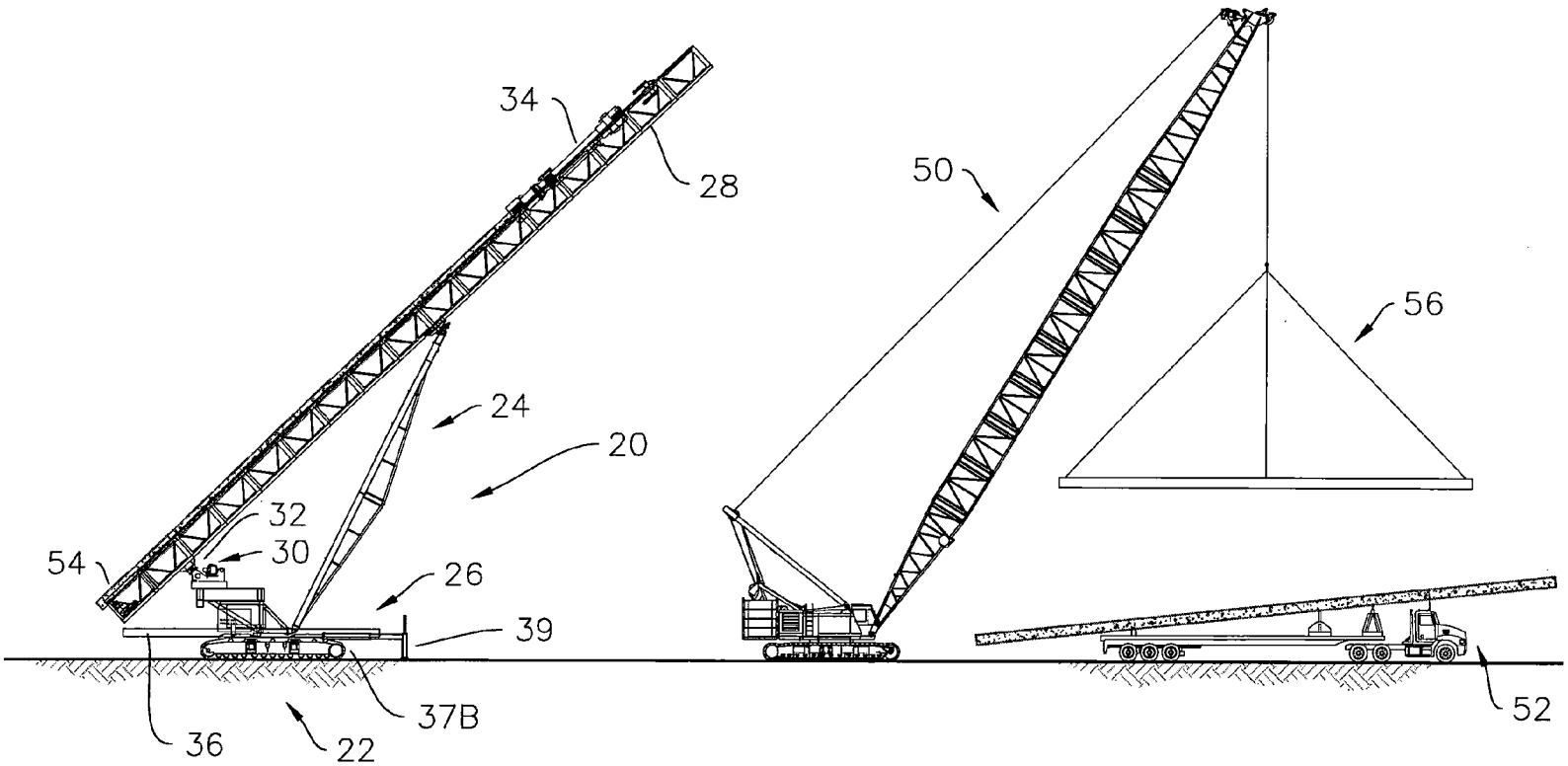
Figure 1G:
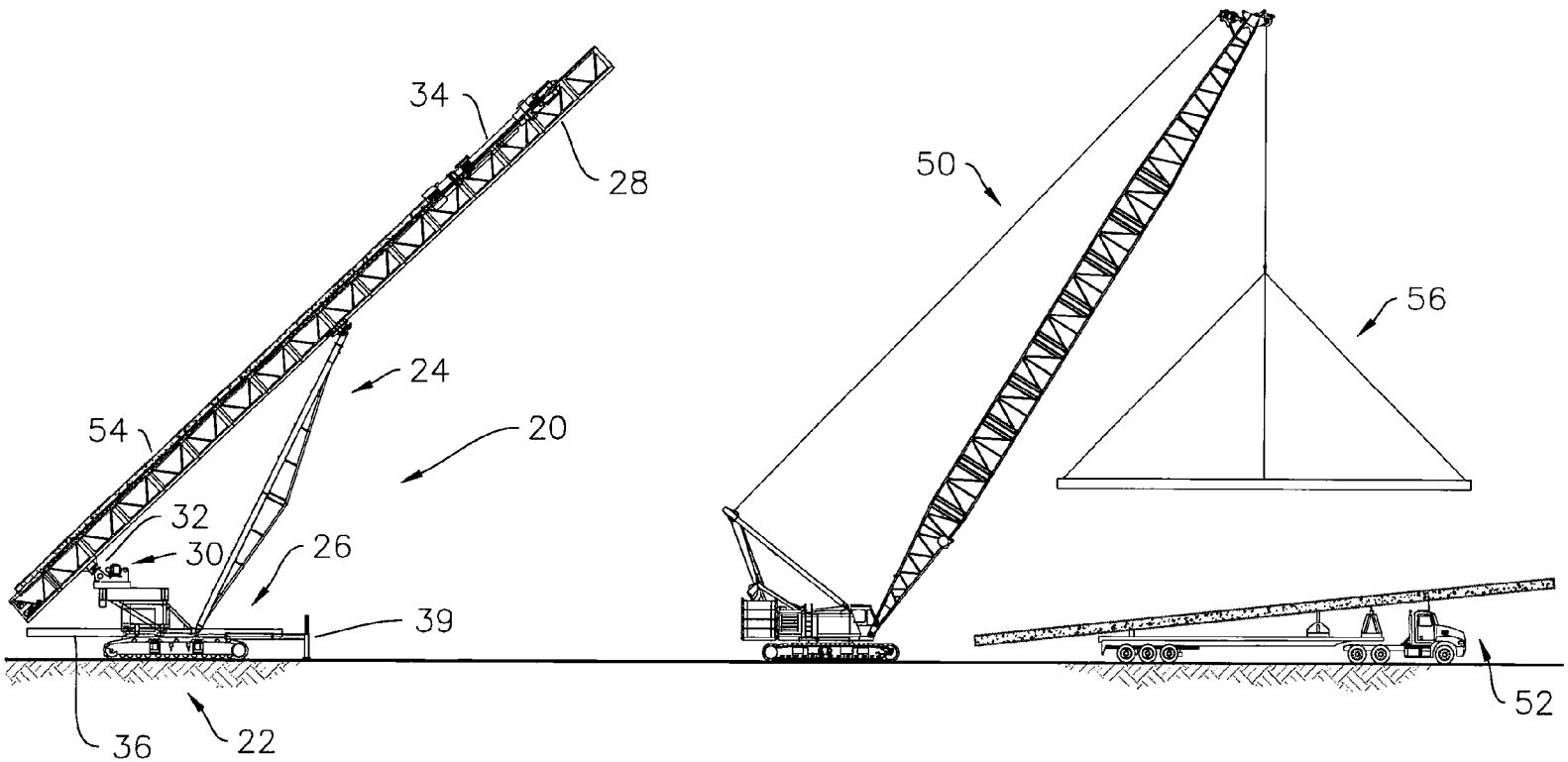
Figure 1H:
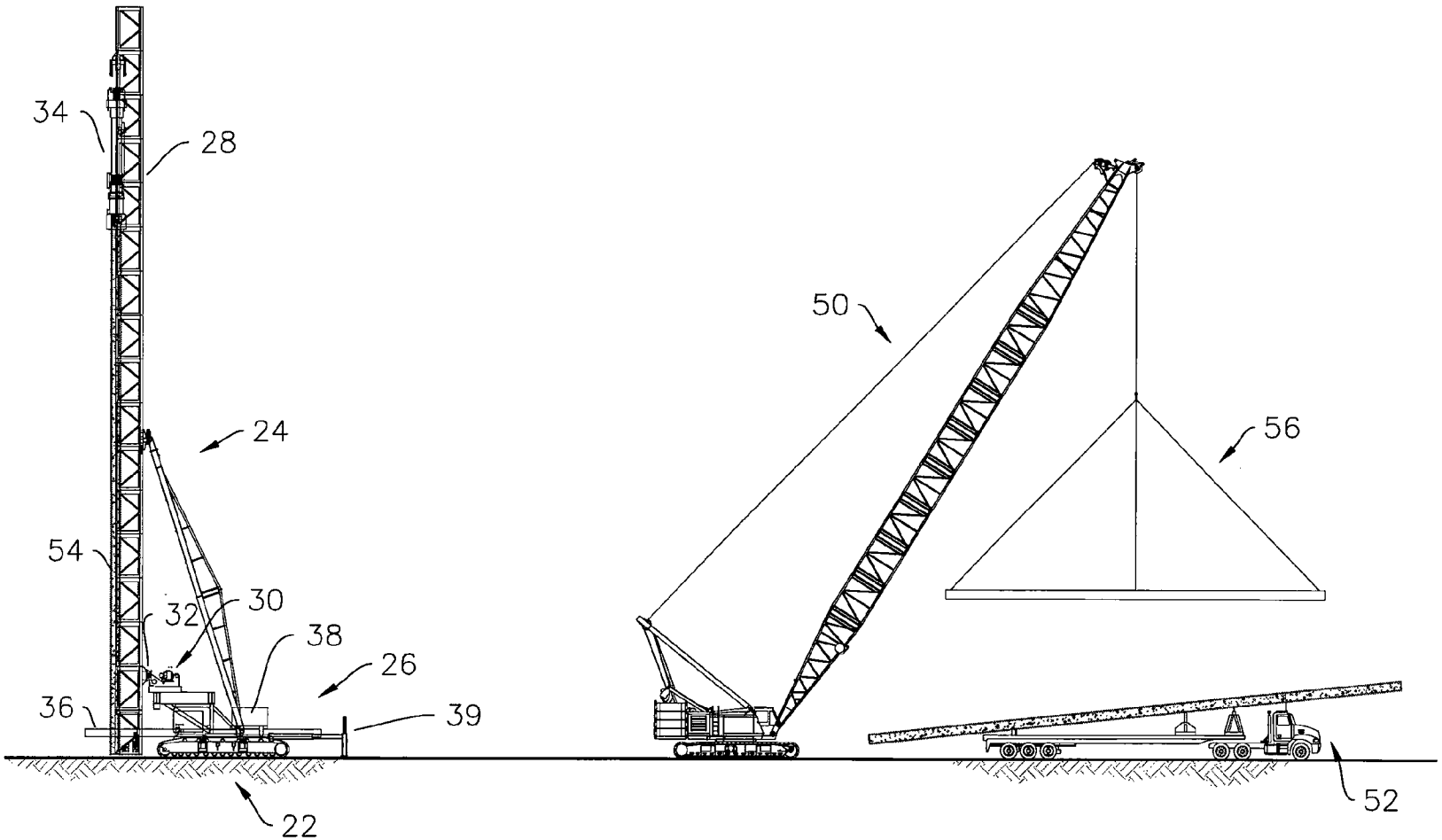

With reference to FIG. 1F, after the crane 50 has loaded the pile 54 into the lead of the pile driver 20, the crane 50 is moved so as not to interfere with the operation of the pile driver 20. This can involve positioning the crane 50 so as to engage another pile that has been transported to the construction site. With continuing reference to FIG. 1F, the pile driver 20 operates so as to begin to rotate the lead 28 and resident pile 54 from the substantially horizontal position towards the desired final vertical position while at the same time adjusting the position of the counterweight 38 to balance the load, i.e., moving the counterweight 38 towards the rear end 37B of the chassis. In this particular example, the pile 54 is of a length that prevents the lead from being rotated to the final vertical or substantially vertical position. To address this situation and with reference to FIG. 1G, the winch associated with the hammer 34 is used to reposition the pile 54 so that the pile 54 no longer interferes with the rotation of the lead 28 to the final position. Such a repositioning of the pile 54 within the lead may also necessitate the repositioning of the counterweight 38 prior to or simultaneously with the repositioning of the pile 54. In other instances, the repositioning of the pile 54 within the lead 28 may not require any repositioning of the counterweight 38. Relatedly, it should be appreciated that simultaneous repositioning of the pile 54 within the lead 28 and the counterweight 38 along the support table 36 can be used to prevent tipping of the pile driver 20. In any event, with reference to FIG. 1H, the rotation of the lead 28 and resident pile 54 proceeds and the counterweight 38 is repositioned as needed until the lead 28 and resident pile 54 reach the desired final, substantially vertical position. The positioning of the lead and resident pile relative to the point on the ground into which the pile is to be driven is typically accomplished using a combination of the chassis steering system, the chassis drive system (i.e., the elements that apply power to the tracks), the rotational capability of the turntable, and the x-y positioning capability of the turntable. Once the lead and resident pile have been placed in the desired vertical position and the pile has been positioned for driving into the ground at the desired location, the driving of the pile 54 into the earth can commence. It should be appreciated that this particular embodiment of the method of using the pile driver 20 is also feasible with a pile driver that does not have a chassis with a turntable. Such a pile driver would utilize the steering system associated with the chassis and any x-y positioning capability or comparable positioning ability that might be associated with whatever chassis structure is supporting the lead to provide the positioning capability that is otherwise achievable using a chassis with a turntable.

With reference to FIGS. 6A-6H, a second embodiment of a method for using the pile driver 20 to drive a pile is described. The second embodiment of the method is substantially identical to that described with respect to FIGS. 1A-1H, except that a straddle crane 56 is employed to lift the pile 54 from the truck 52, transport the lifted pile 54 to the pile driver 20, and load the lifted pile 54 into the lead of the pile driver 20. The straddle crane 56 is comprised of an inverted U-shaped frame that is capable of straddling the bed of the truck 52 or other conveyance, a winch system for lifting a pile off of the truck 52 or other conveyance, a motor/engine system, wheels with tires, a transmission system for providing power from the motor/engine system to at least a pair of the wheels, and a steering system. The winch system of the straddle crane 56 is equipped with a lifting bar that, like with the crawler crane 50, facilitates the cradling of the pile 54 during movement of the pile 54 from the truck 52 to the pile driver 20. While the illustrated straddle crane 56 is wheeled, it should be appreciated that a straddle crane that employs rails, tracks, or a combination of tracks and wheels with tires is also feasible. If there are significant or potential overhead obstacles at a particular construction site, the use of the straddle crane 56 may be preferable to the use of a crawler crane, such as crane 50.

With reference to FIGS. 7A-7G, a third embodiment of a method for using the pile driver 20 to drive a pile is described. The third embodiment of the method is substantially identical to that described with respect to FIGS. 1A-1H, except that a pair of pipe layers 60A, 60B are employed to lift the pile 54 from the truck 52, transport the lifted pile 54 to the pile driver 20, and load the lifted pile 54 into the lead of the pile driver 20. Each of the pipe layers 60A, 60B includes a hook or similar structure for engaging the pile, a winch, a cable with one end connect to the hook and the other end connected to the winch, a mast, and a pulley that is connected to the mast and engages a portion of the cable extending between the winch and the hook, a traction system (treads, wheels/tires, and combinations thereof), a steering system, and an engine/motor for providing power to drive the traction system and to provide power to the winch. In operation, the winch associated with each of the pipe layers 60A, 60B is used to lower the hook to engage the pile located on the truck 52 and then raise the hook to lift the pile from the truck. The pipe layers 60A, 60B then cooperate to move the pile to the pile driver 20 and load the pile into the lead 28. If there are significant or potential overhead obstacles at a particular construction site and/or the pile driver 20 can only be approached from one side, the use of the pipe layers 60A, 60B may be preferable to the use of a straddle crane, such as straddle crane 56.

Figure 8A:
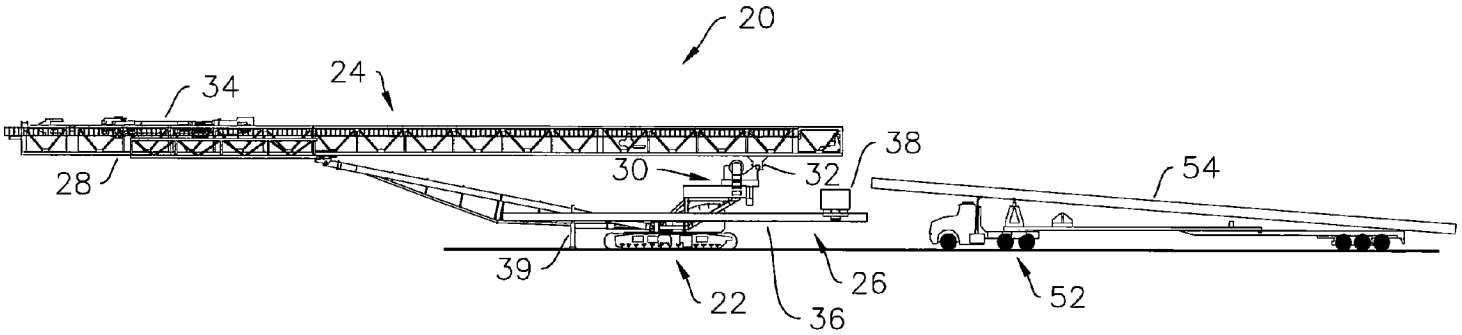
FIGS. 8A-8F illustrate the embodiment of the pile driver illustrated in FIGS. 1A-1H and a fourth embodiment of a method that utilizes the pile driver in establishing a pile in the earth.

With reference to FIGS. 8A-8F, a fourth embodiment of a method for using the pile driver 20 to drive a pile is described. In this embodiment, the use of an intermediate device, such as the crawler crane 50 or straddle crane 56, to move the pile 54 from the truck 52 or other conveyance to the pile driver 20 is avoided. With reference to FIG. 8A, initially, the pile driver 20 and the truck 52 with the pile 54 are brought adjacent to one another. Further, the pile driver 20 is positioned such that the open end of the lead 28 (i.e., the end of the lead 28 from which the pile issues when the pile is being driven) is positioned adjacent to one end of the pile 54 on the truck 52. Typically, this involves using the turntable associated with the chassis 22 to rotate the lead 28 into position to receive the pile 54.

Figure 8B:
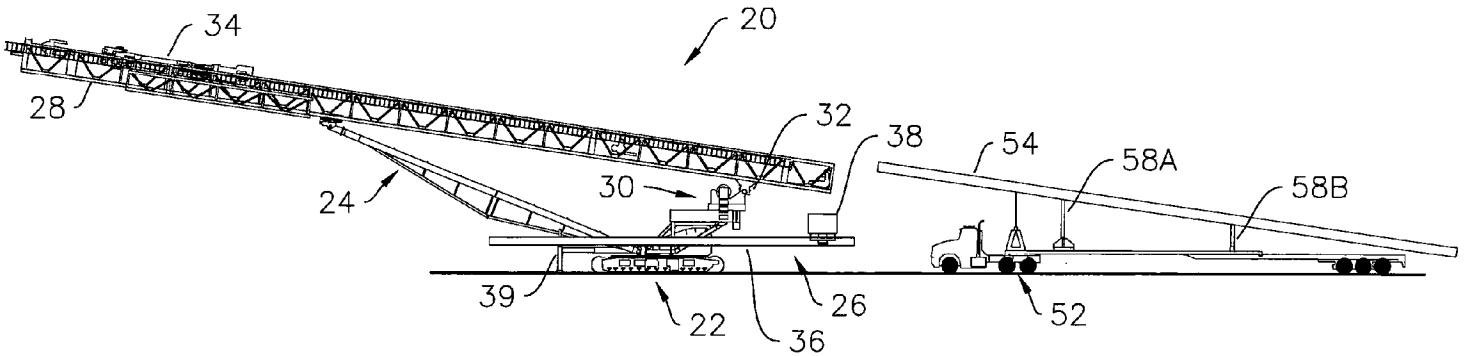

With reference to FIG. 8B, the lead 28 and pile 54 are aligned so that the pile can be pushed and/or pulled from the truck 52 onto the lead 28. As such, the longitudinal axis of the pile 54 and the longitudinal axis of the lead 28 are substantially colinear at a point shortly before the pile engages the lead. In the illustrated embodiment, the alignment involves both rotating the lead 28 and using jacks with rollers 58A, 58B associated with the truck 52 to position the pile 54 appropriately. Preferably, the height of each of the jacks 58A, 58B can be independently adjusted to substantially conform the angle of the pile 54 (relative to horizontal) to the angle of the lead 28 (relative to horizontal). Further, the jacks with rollers 58A, 58B each preferably have the ability to laterally displace one end of the pile, thereby providing additional alignment capability. For instance, if each jack operates to displace an end of a pile by an equal amount, the pile is moved parallel to its prior location. In contrast, if each jack operates to displace its respective end of a pile by a different amount or only one jack operates to displace its end of the pile, then the angle of the pile relative to a vertical plane is changed. In one embodiment, lateral displacement is accomplished by laterally displacing the vertical element of a jack. In another embodiment, lateral displacement is accomplished by laterally displacing the horizontal member of the jack upon which the pile rests relative to the vertical member of the jack. In yet a further embodiment, lateral displacement is accomplished by moving the pile from one position to another position on the horizontal member of the jack upon which the pile rests. The lateral displacement in each of these embodiments is accomplished using hydraulic elements. However, it should be appreciated that other mechanical systems that employ a one or more winches, pulleys, gears, racks, pinions etc., and combinations of such elements can also be employed.

Figure 8C:
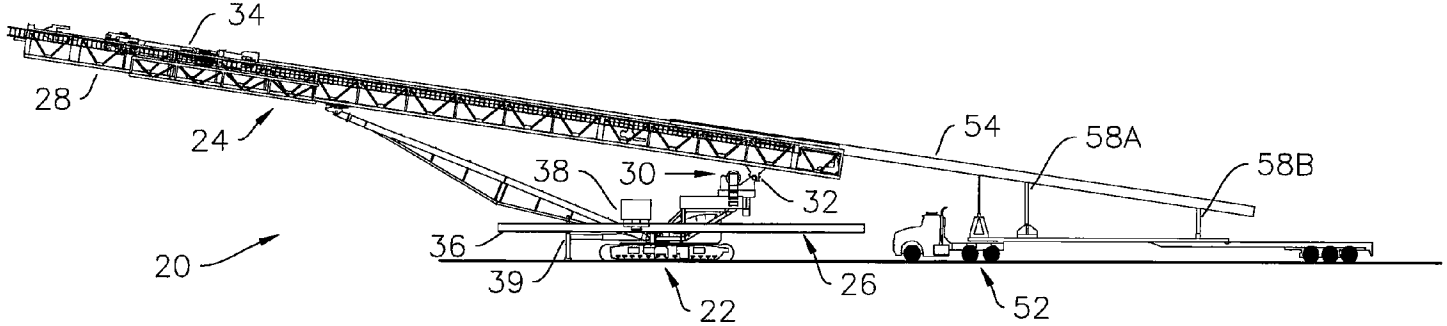
Figure 8D:
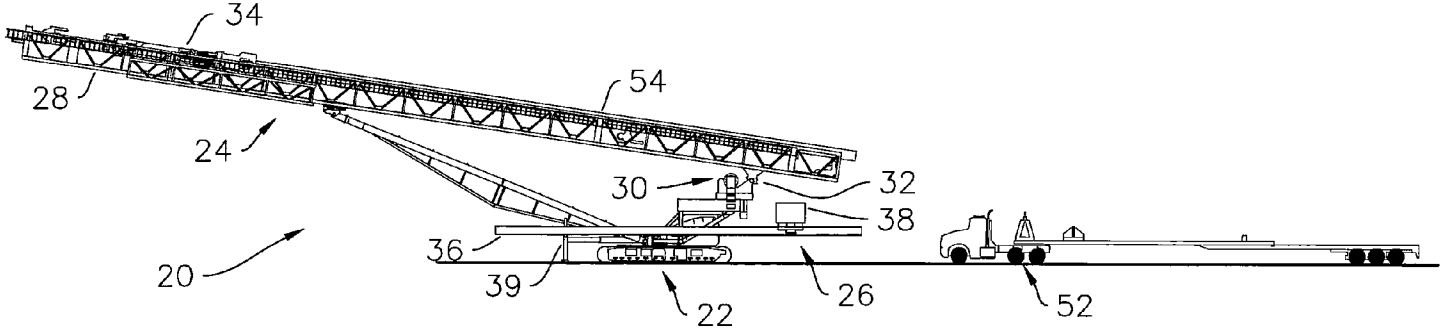
Figure 8E:
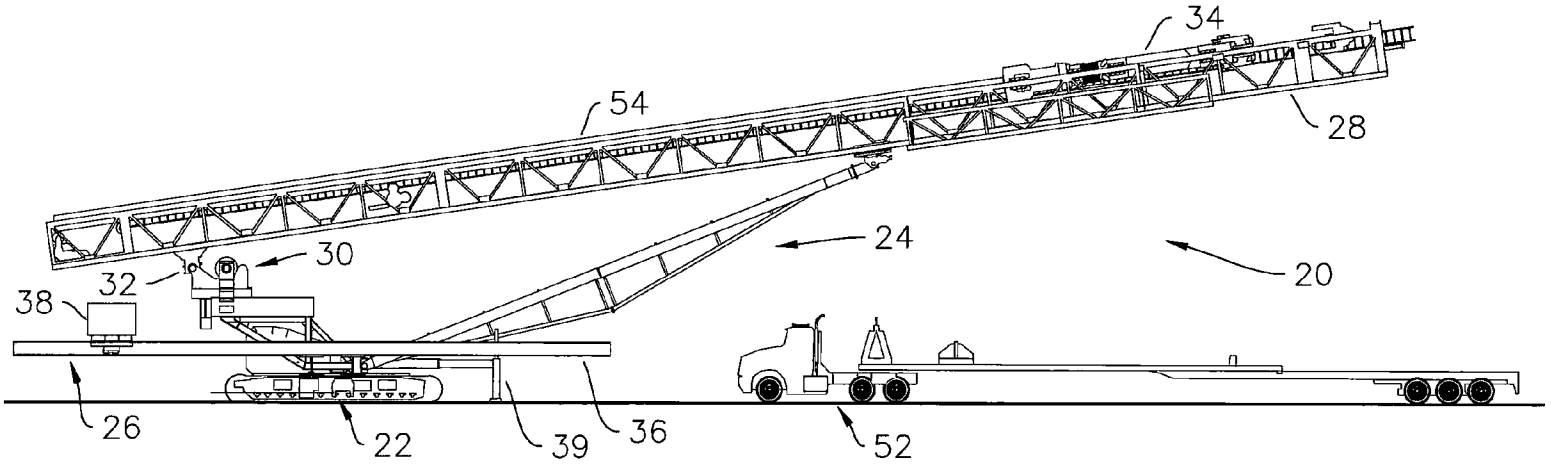
Figure 8F:
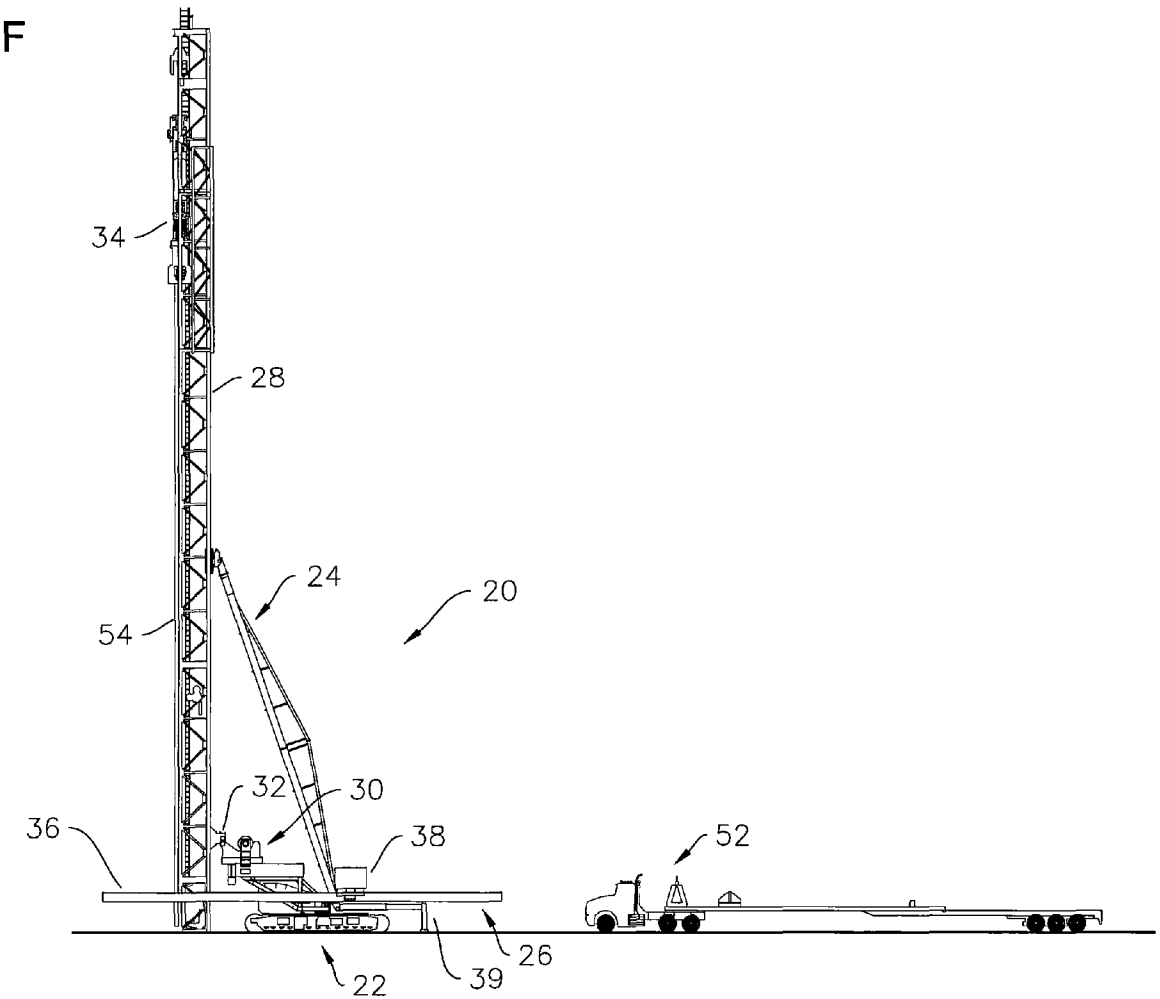

With reference to FIG. 8C, after the pile 54 has been aligned with the lead 28, the pile 54 is pulled and/or pushed onto the lead 28. In the illustrated embodiment, the winch associated with the hammer 34 is used to pull the pile 54 onto the lead 28. While the pile 54 is being moved onto the lead 28, the position of the counterweight 38 is being adjusted to balance the load, as needed. With reference to FIGS. 8D and 8E, after the pile 54 is loaded onto the lead 28, the turntable is rotated to place the lead 28 and resident pile 54 in the appropriate position to be rotated from the substantially horizontal position to the desired substantially vertical position. It should be appreciated, however, that the pile can be rotated from the substantially horizontal position to the desired substantially vertical position before the turntable is rotated or during the same period of time as the turntable is being rotated. With reference to FIGS. 8E and 8F, the lead 28 and the retained pile 54 are rotated to the desired vertical position for driving. The counterweight 38 is repositioned as needed during the rotation. Further, the lead 28 is capable of being and has been extended to accommodate the pile 54. The lengthening of the lead 28 and the position of the pile in the lead (along with any other relevant factors) needs to be taken into account when determining the appropriate position for the counterweight 28. The positioning of the lead 28 and resident pile 54 relative to the point on the ground into which the pile is to be driven is typically accomplished using a combination of the chassis steering system, the chassis drive system (i.e., the elements that apply power to the tracks), the rotational capability of the turntable, and/or the x-y positioning capability of the turntable.

Figure 9A:
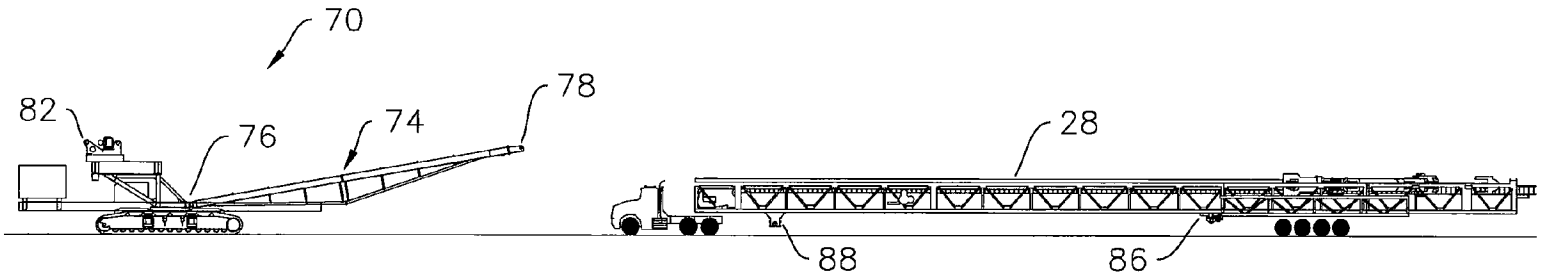
FIGS. 9A-9B respectively illustrate the lead separated from the remainder of the pile driver and joined to the remainder of the pile driver.
Figure 9B:
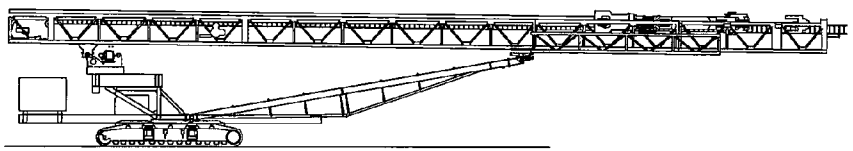
Figure 10C:
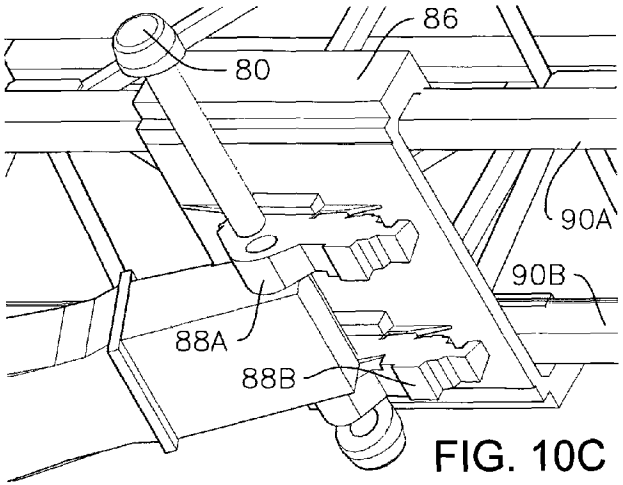
FIGS. 10A-10D show the establishment of a pivot connection between a truss that supports the lead and the lead for the embodiment of the pile driver illustrated in FIGS. 1A-1H.
Figure 10D:
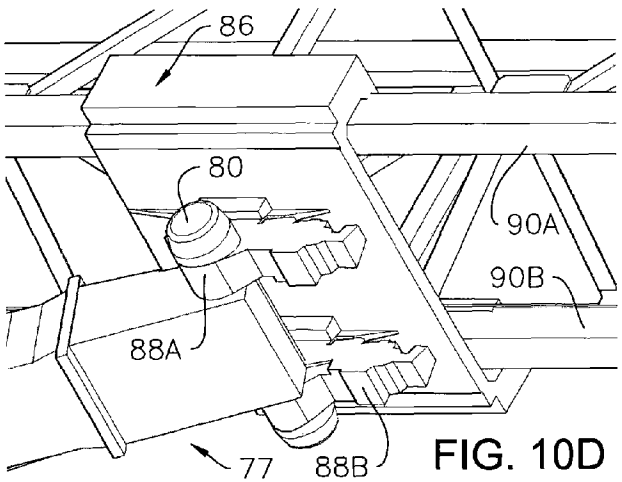
Figure 10A:
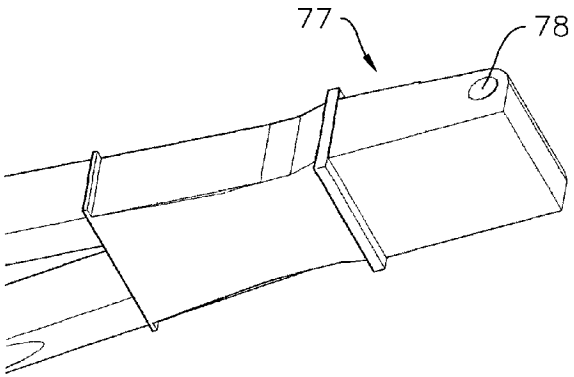
Figure 10B:
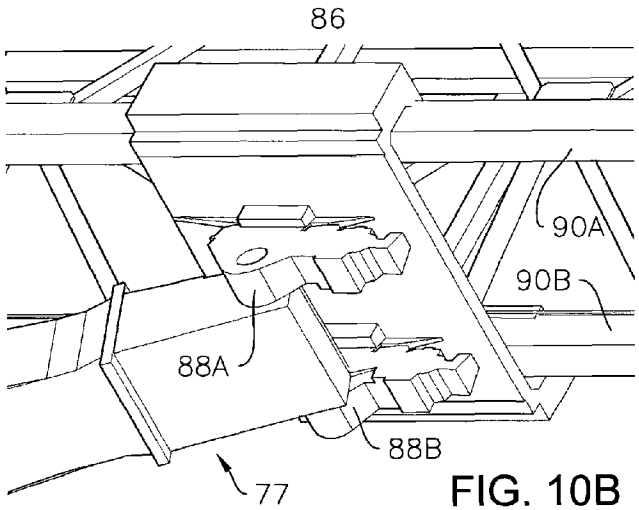
Figure 11:
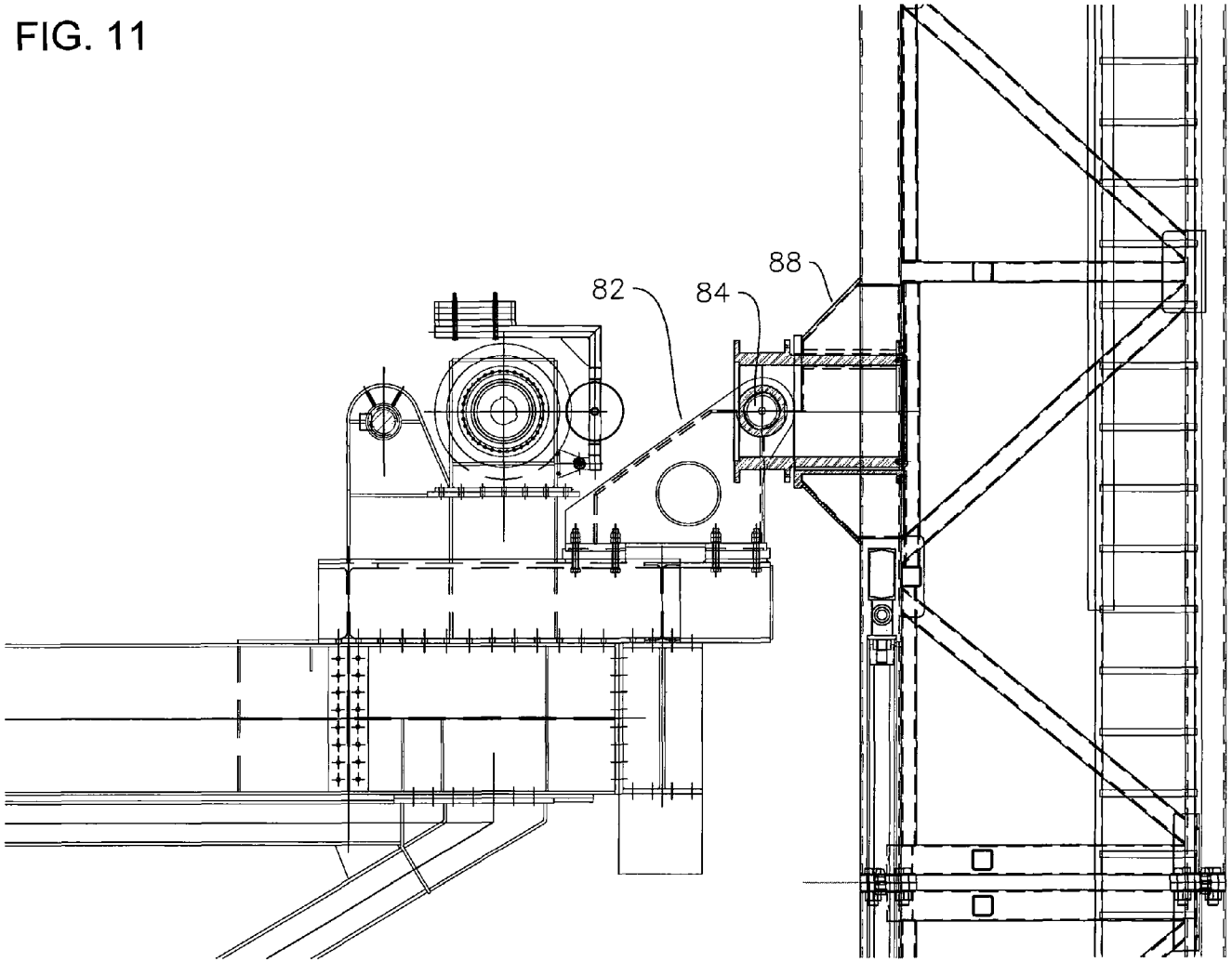
FIG. 11 illustrates the connection between a mount that is operatively connected to the chassis and the lead that defines the pivot axis about which the lead rotates when the pile driver illustrated in FIGS. 1A-1H is in operation.

With reference to FIGS. 9A-9B, the lead 28 can be separated from the remainder of the remainder of the pile driver 70 (i.e., the chassis, the rotatable lead system less the lead, and the counterweight system) and subsequently connected to the remainder of the pile driver 70. The ability to separate the lead 28 from the remainder of the pile driver 70 facilitates the movement of the pile driver from one location to another over highways and the like. To elaborate, the overall height of the pile driver 20 when the lead 28 is horizontally disposed is likely to prevent the pile driver 20 from being transported over roads that have bridges and overpasses with limited clearances. The ability to separate the lead 28 from the remainder of the pile driver 70 allows the lead 28 and the remainder of the pile driver 70 to be transported over such roads. Once the lead 28 and the remainder of the pile driver 70 are at the desired location, the lead 28 can be reattached to the remainder of the pile driver 70 to establish the pile driver 20. Typically, a crawler crane or other suitable device is used to lift the lead 28 from a truck or other conveyance and position the lead 28 for connection to the remainder of the pile driver 70. It should be appreciated that the remainder of the pile driver 70 can, if necessary, be broken down into subcomponents if needed.

With reference to FIGS. 9A-9B, 10A-10D, and 11, the ability to connect and disconnect the lead from the remainder of the pile driver 70 is described in greater detail. The rotatable lead system 24 includes a lead support frame that is associated with the remainder of the pile driver 70. The lead support frame is comprised of (a) a truss 74 having a first end that is pivotally connected to the chassis 22 at pivot 76 and a second end 77 that defines a hole 78 for accommodating a portion of a pin with locking nut 80 for pivotally connecting the truss 74 to the lead 28 and (b) a mount 82 that defines a hole for accommodating a portion of a pin with locking nut 84 for pivotally connecting the mount 82 and the lead 28. The pivotal connection between the mount 82 and the lead 28 establishes the pivot 32, i.e., the horizontal axis about which the lead 28 can be rotated. The lead 28 includes a slider 86 with a pair of bosses 88A, 88B, each with a hole that accommodates a portion of the pin with locking nut 80. The slider 86 engages a pair of rails 90A, 90B associated with the lead 28. In operation, the slider 86 moves along the rails 90A, 90B when the lead 28 is rotated. The lead 28 also include a mount 88 with a hole for accommodating a portion of the pin with locking nut 84 for pivotally connecting the mount 82 and the mount 88 and establishing the pivot 32. FIGS. 10A-10D illustrate the alignment of the hole 78 defined by the second end 77 of the truss 74 with the holes in the bosses 88A, 88B associated with the slider 86 and the establishment of the pin with locking nut 80 in the aligned holes to establish the pivot connection between the truss 74 and the lead 28. The pivot connection between the mount 82 and the mount 88 with the pin with locking nut 84 is established in a similar manner. Separation of the lead 28 from the remainder of the pile driver 70 involves appropriately supporting the lead 28 (typically, with a crane) and removing the pin with locking nuts 80, 84.

Figure 12C:
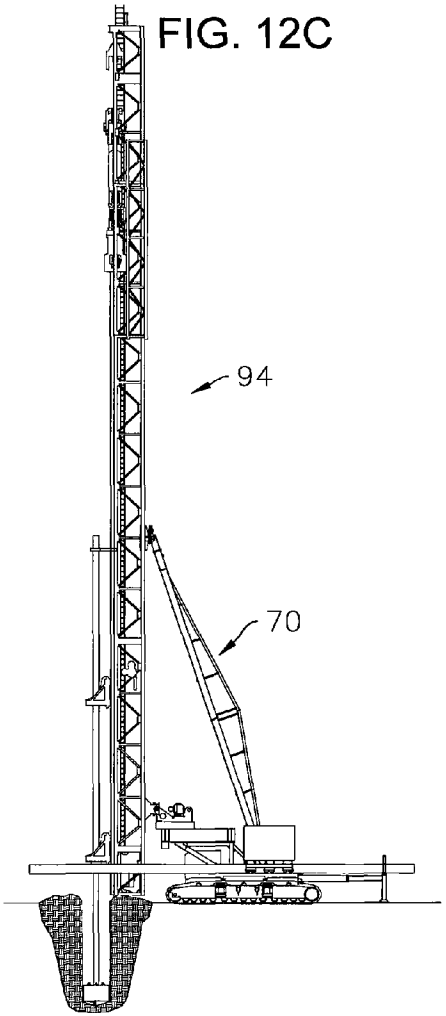
FIGS. 12A-12C illustrate three different pile driving leads that can be employed, namely, a pile driver lead, a combination pile driver-auger lead, and a combination pile driver-bucket/drum drill lead.
Figure 12B:
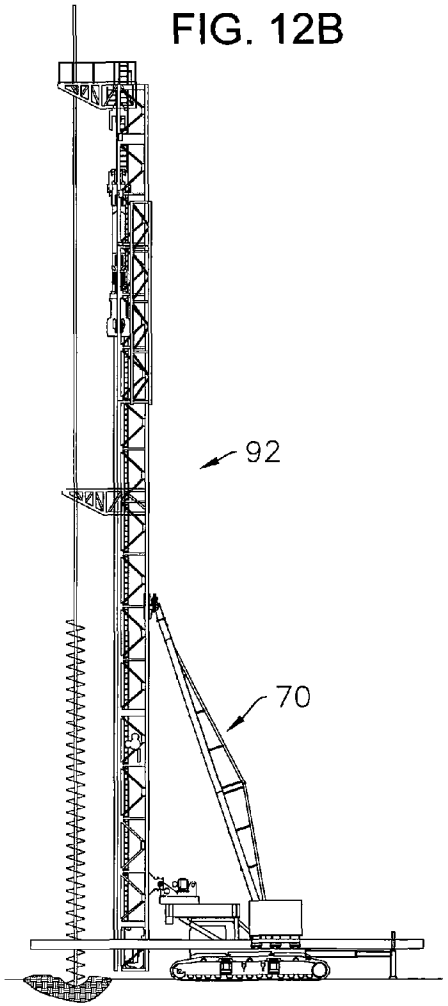
Figure 12A:
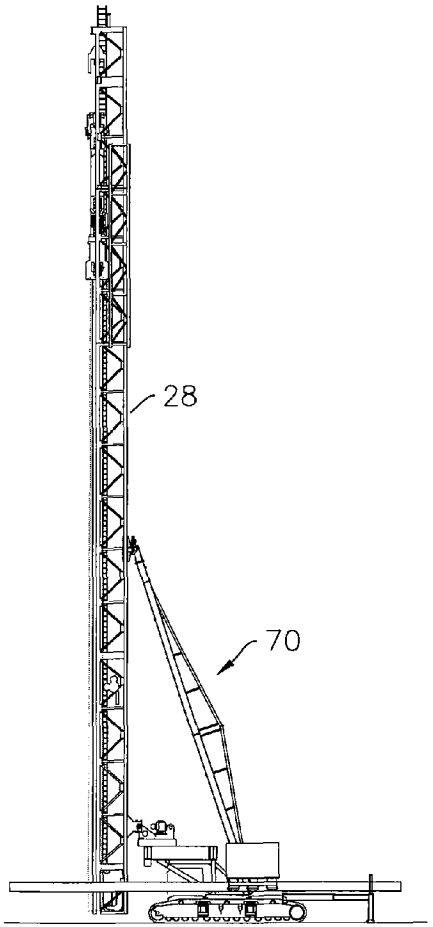

With reference to FIGS. 12A-12C, the ability to readily connect-disconnect the lead 28 and the remainder of the pile driver 70 also allows different types of pile driving leads to be employed with the remainder of the pile driver 70. In this regard, FIG. 12A illustrates the use of the pile driver lead 28 with the remainder of the pile driver 70. FIG. 12B illustrates the use of a combination auger-pile driver lead 92 with the remainder of the pile driver 70. FIG. 12C illustrate the use of a combination bucket/drum drill-pile driver lead 94 with the remainder of the pile driver 70.

Figure 13A:
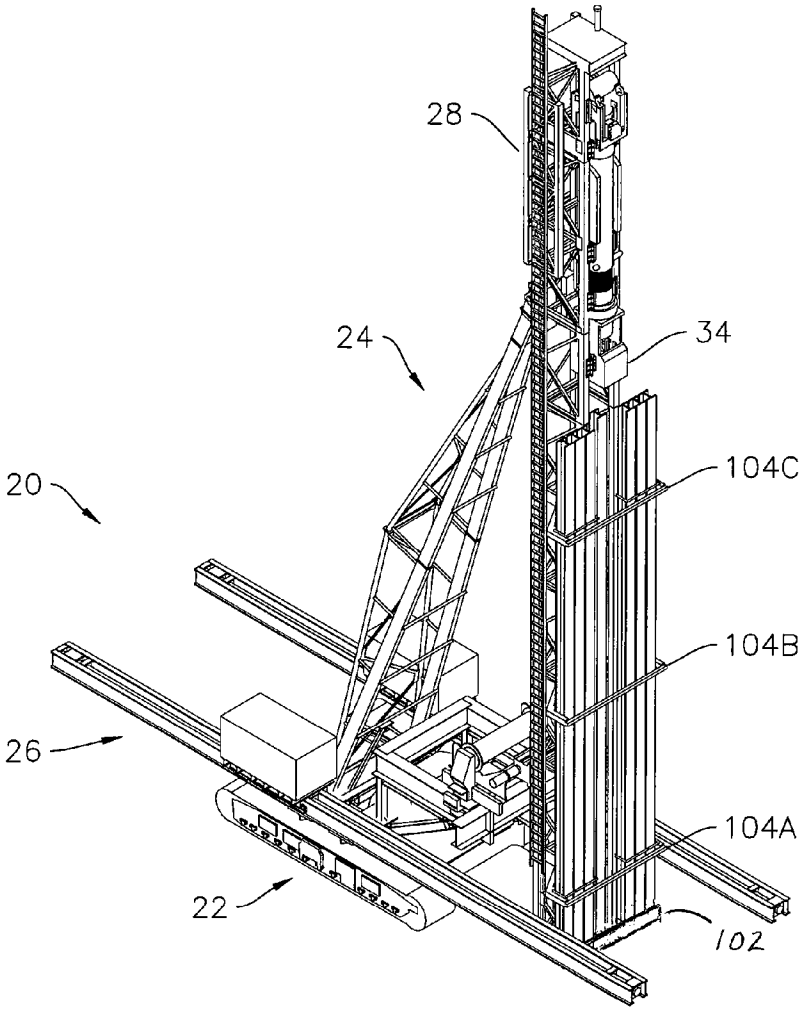
FIG. 13A is a perspective view of the pile driver of FIGS. 1A-1H with a linear magazine of piles and with the lead in position to drive piles provided by the magazine.
Figure 13B:
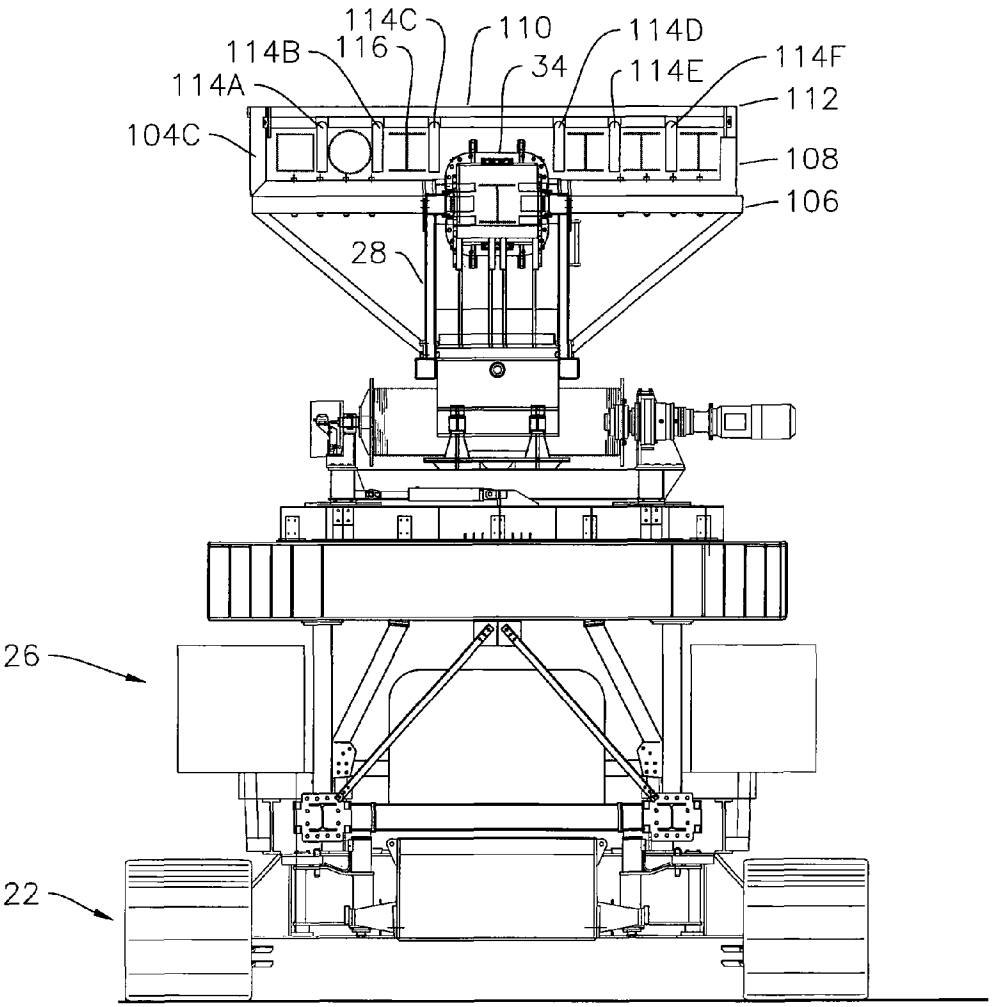
FIG. 13B is a front view of the pile driver of FIGS. 1A-1H with a linear magazine of piles and with the lead in a horizontal position.

With reference to reference to FIGS. 13A and 13B, the pile driver 20 can be used in conjunction with a linear pile magazine 100 that is capable of storing a number of piles and allowing one pile at a time to be engaged by the hammer 34. Generally, the magazine 100 is a box-like cage that is comprised of a tray 102 that supports the lower end of each of the piles in the magazine, three rectangular bands 104A-104C, a frame 106 that connects the bands 104A-104C to one another and to the lead 28. Preferably, each of the rectangular bands 104A-104C is comprised of a first section 108, a second section 110, and a latch 112 that allows the second section 110 to be separated from the first section 108 when piles are to be loaded into the magazine and subsequently reattached to the first section 108 after piles have been loaded into the magazine. With respect to at least rectangular bands 104A and 104C, the second section 110 includes fingers 114A-114F that divide the space in the magazine into six compartments, each of which is capable of accommodating a pile. Further, each of the fingers 114A-114F can be rotated so as to allow a pile to be placed in position to be engaged by the hammer 34 while preventing the other piles from moving. For example, the finger 114C associated with each of the bands 104A and 104C can be rotated so that the H-beam pile 116 located between fingers 114C and 114B can be positioned for engagement by the hammer 34. Generally, the fingers 114A-114F associated with the band 104C are positioned somewhat closer to the center of the magazine than the fingers 114A-114F associated with the band 104A. As such, each of the piles held by the magazine leans slightly towards the center of the magazine and will tip towards the center of the magazine when the fingers that are keeping the pile in place are rotated and be in position to be engaged by the hammer 34 or a structure associated with the hammer, such as a collar. Once engaged by the hammer 34 or associated structure, the pile can then be removed from the magazine and positioned for driving into the ground.

With reference to FIG. 13B, the magazine 100 can accommodate different types of piles. For instance, the magazine can accommodate a square cross-section pile, a circular cross-section pile, and an H-beam cross-section pile to name a few. Further, loading of piles into the magazine 100 is accomplished with the lead 28 and the magazine 100 in a substantially horizontal position.

Figure 14:
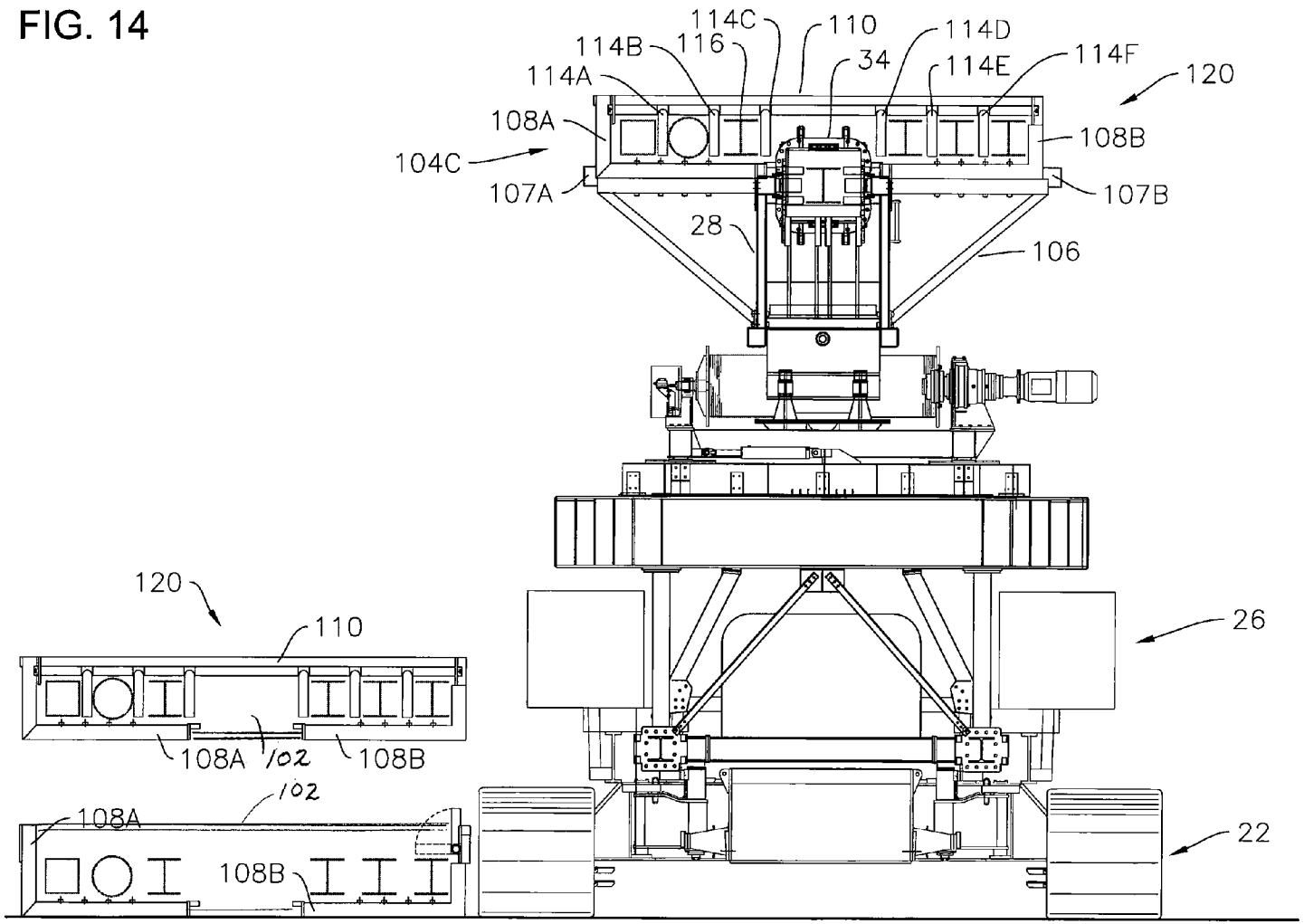
FIG. 14 illustrates a removable linear magazine for piles that can be used with the pile driver of FIGS. 1A-1H.

With reference to FIG. 14, a linear magazine for piles 120 that can be detached from the lead 28 and subsequently reattached to the lead is described. The ability to detach and reattach the magazine 120 allows for the use of two magazines with the pile driver 20. To elaborate, while one of the magazines is associated with the pile driver 20, the other magazine can be being load or reloaded with piles. After all the piles in the magazine associated with the pile driver 20 have been driven, the magazine can be detached from the pile driver 20 and the other loaded magazine attached to the pile driver. The linear magazine 120 is similar to the magazine 100 in many respects. As such, common elements between the magazine 120 and magazine 100 are given the same reference numbers. Because the rectangular bands 104A-104C of the magazine 120 are not connected to one another by the frame 106, the portions 108A, 108B of each of the bands 108 are connected to one another and to the tray 102 by stringers that, in combination with bands, create the magazine 120 that can be lifted into place for engagement with the lead by a crawler crane or other suitable device. Multiple latches 107A, 107B are used to connect the magazine 120 to the frame 106.

Figure 15A:
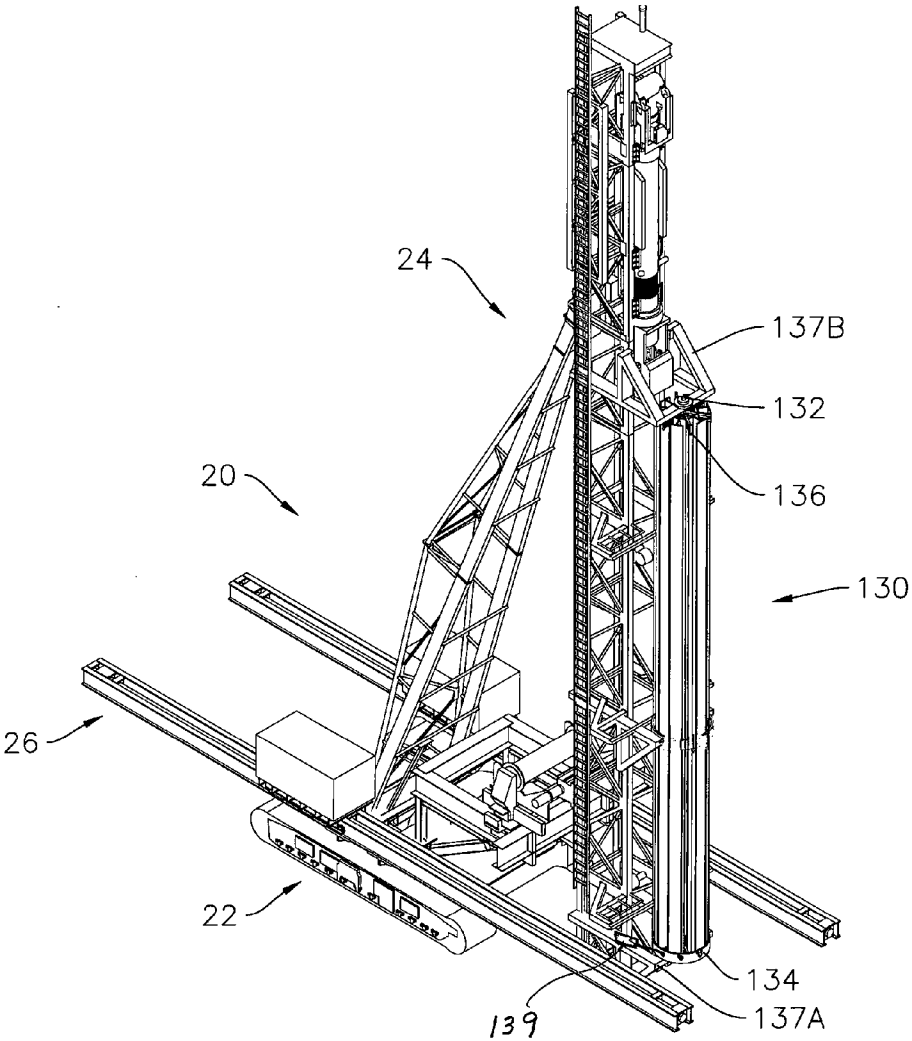
FIG. 15A is a perspective view of the pile driver of FIGS. 1A-1H with a cylindrical magazine for pile and with the lead in position to drive piles provided by the magazine.
Figure 15B:
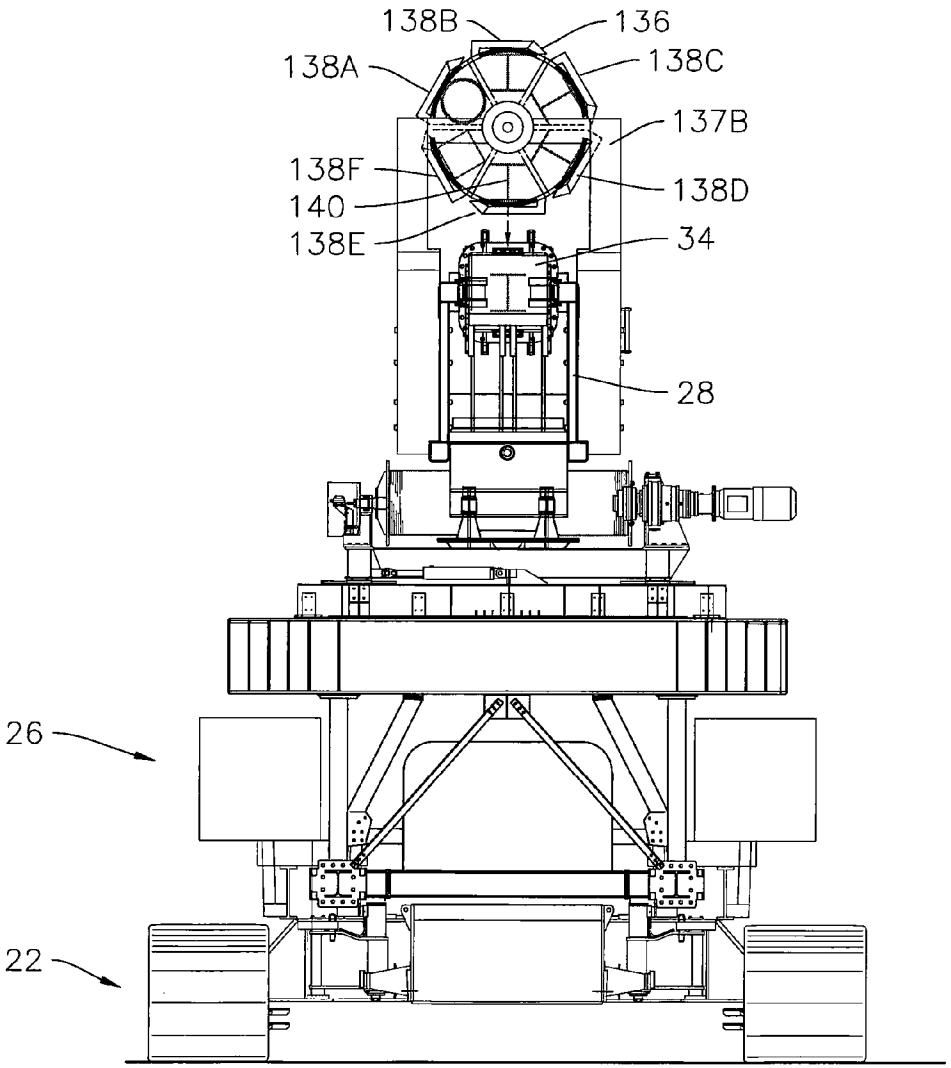
FIG. 15B is a front view of the pile driver of FIGS. 1A-1H with a cylindrical magazine of piles and with the lead in a horizontal position.

With reference to reference to FIGS. 15A and 15B, the pile driver 20 can be used in conjunction with a cylindrical pile magazine 130 that is capable of storing a number of piles and allowing one pile at a time to be engaged by the hammer 34. Generally, the magazine 130 is a cylindrical cage that is comprised of an axle 132, a tray 134 that is connected to one end of the axle 132 and has dividers that create six separate sections which each support one end of a pile, a divider 136 that is connected to the other end of the axle 132 and has six separate sections that each contain one end of a pile, a frame with a first portion 137A that supports one end of the axle and a second portion 137B that supports the other end of the axle, and a motor for rotating the cylindrical structure formed by the axle, tray, and divider. The motor 139 is comprised of a hydraulic cylinder with a first end and a second end from which a piston rod projects to a desired length. The end of the piston rod defines a hole for receiving a pin. The tray includes six slotted bosses situated on the outside of the tray 134, each boss defining a pair of holes, one on each side of the slot and capable of accommodating the pin. In operation, the pin is used to connect the piston to one of the bosses. The cylinder is then operated so that the piston causes the tray 134 and all the related structure to rotate about the axle 132 to an extent that a pile in the magazine is positioned for engagement. The pin is then removed from the boss and attached to another boss. Other types of motors known to those skilled in the art are feasible. For example, an electric motor with gear structure can also be used. The circumference of the divider 136 is comprised of movable fingers 138A-138F, each of which is associated with one of the sections of the divider and can be rotated so as to allow the pile that is retained in the section to be removed from the cylindrical structure and positioned for engagement by the hammer 34 or structure associated with the hammer. For example, the finger 138E can be rotated so as to allow the pile 140 to be engaged by the hammer 34 or a structure associated with the hammer, such as a collar, and moved out of the tray 134 and brought into position for driving into the ground by the hammer 34. After a pile has been removed from the cylindrical structure, the motor 139 is used to rotate the cylindrical structure such that another pile held by the cylindrical structure can subsequently be brought into position for engagement by the hammer 34. The magazine 130 can accommodate different piles, including piles with circular, square/rectangular, and H-beam cross-sections. Additionally, piles are typically loaded into the magazine 130 with the lead 28 and the magazine 130 in a substantially horizontal position.

Figure 16:
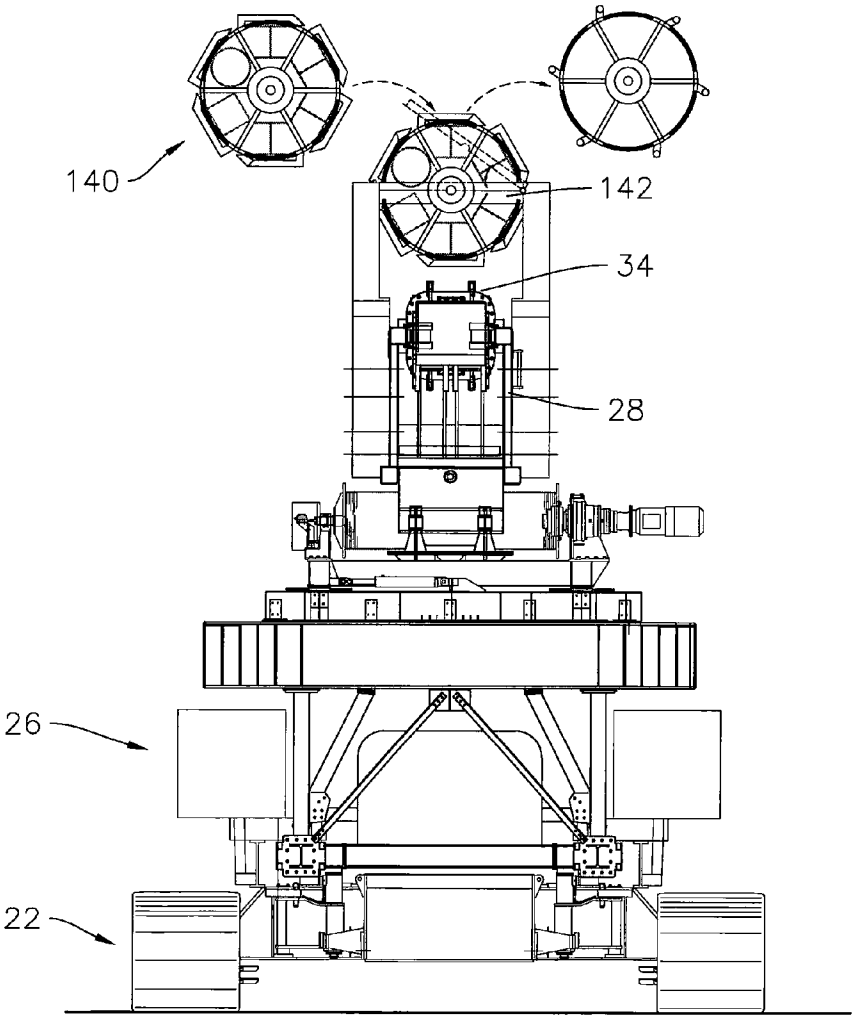
FIG. 16 illustrates a removable cylindrical magazine for piles that can be used with the pile driver of FIGS. 1A-1H.

With reference to FIG. 16, a cylindrical magazine for piles 140 that can be detached from the lead 28 and subsequently reattached to the lead is described. The ability to detach and reattach the magazine 140 allows for the use of two magazines with the pile driver 20. To elaborate, while one of the magazines is associated with the pile driver 20, the other magazine can be being load or reloaded with piles. After all the piles of the magazine associated with the pile driver 20 have been driven, the magazine can be detached from the pile driver 20 and the other loaded magazine attached to the pile driver. The cylindrical magazine 140 is similar to the magazine 130 in many respects. As such, common elements between the magazine 120 and magazine 100 are given the same reference numbers. To allow the cylindrical magazine 140 to be detached and attached to the pile driver 20, a frame is provided with a first portion that supports one end of the axle (and is substantially identical to first portion 137A) and a second portion 142 comprised of a first cross-beam and a second hinged, cross-beam that can be latched to the first cross-beam. When the first and second cross-beams are latched to one another, a hole is defined that retains one end of the axle. When the first and second cross-beams are not latched, the second cross-beam can be swung out of the way so that the magazine 140 can be removed.

It should be appreciated that a chassis without a turntable can also be utilized. When such a chassis is utilized, the steering system associated with the chassis and any x-y positioning capability or comparable positioning ability that might be associated with whatever chassis structure is supporting the lead are used in accomplishing the positioning of the lead for receiving the pile 54 and the positioning of the lead 28 and resident pile 54 for driving the pile into the ground at the desired point.

The foregoing description of the invention is intended to explain the best mode known of practicing the invention and to enable others skilled in the art to utilize the invention in various embodiments and with the various modifications required by their particular applications or uses of the invention.

What is claimed is:

1. A piling driving apparatus comprising:

a chassis comprising a frame and a traction system for engaging the ground and capable of being used to move the frame relative to the ground;

a lead system, operatively attached to the chassis, comprising:

a pile driving lead, and a lead drive system comprising a lead support frame for supporting the lead and constraining the lead to rotate about a first pivot axis, and a lead motor for applying a rotational force to the lead so as to position the lead in a range that extends from the lead being substantially parallel to the ground to being substantially vertical relative to the ground; and a counter-weight system, operatively attached to the chassis, comprising a weight, a weight table for supporting the weight, and a weight drive system for causing the weight to move relative to the chassis so as to counteract the rotational moment associated with a pile resident in the lead and thereby prevent tipping.

2. A pile driving apparatus, as claimed in claim 1, wherein:

the weight drive system comprises one of: a cable winch, a rack-and-pinion, a chain, a pneumatic cylinder, and a hydraulic cylinder.

3. A pile driving apparatus, as claimed in claim 1, wherein:

the table extends from a first terminal end to a second terminal end.

4. A pile driving apparatus, as claimed in claim 3, wherein:

the first and second terminal ends of the table are each located beyond the chassis.

5. A pile driving apparatus, as claimed in claim 3, wherein:

only one of the first and second terminal ends of the table is located beyond the chassis.

6. A pile driving apparatus, as claimed in claim 1, wherein:

the table comprises a first table portion and a second table portion that engages the first table portion.

7. A pile driving apparatus, as claimed in claim 6, further comprising:

a table motor for causing relative movement between the first and second table portions.

8. A pile driving apparatus, as claimed in claim 1, further comprising:

an outrigger capable of being deployed to extend beyond an end of the chassis and engaging the ground so as to deter tipping.

9. A pile driving apparatus, as claimed in claim 1, further comprising:

a magazine capable of holding a plurality of piles adjacent to the lead.

10. A pile driving apparatus, as claimed in claim 9, wherein:

the magazine is one of: (a) a linear magazine and (b) a cylindrical magazine.

11. A pile driving apparatus, as claimed in claim 9, further comprising:

a magazine connector that allows the pile magazine to be connected to and disconnected from the lead.

12. A pile driving apparatus, as claimed in claim 1, wherein:

the lead drive system comprises a lead connector that allows the pile driving lead to be readily connected to and disconnected from the lead support frame.

13. A pile driving apparatus, as claimed in claim 12, wherein:

the pile driving lead can be replaced with one of the following: (a) an auger lead and (b) a bucket/drum drill lead.

14. A method comprising:

providing a pile driving apparatus comprising:

a chassis with a frame and a traction system that is operatively connected to the frame and capable of being used in moving the frame over the ground;

a lead system, operatively attached to the chassis, comprising:

a pile driving lead, and a lead drive system comprising a lead support frame for supporting the lead and constraining the lead to rotate about a first pivot axis, and a lead motor for applying a rotational force to the lead so as to position the lead in a range that extends from the lead being substantially parallel to the ground to being substantially vertical relative to the ground; and a counter-weight system, operatively attached to the chassis, comprising a weight, a weight table for supporting the weight, and a weight drive system for causing the weight to move relative to the chassis so as to counteract the rotational moment associated with a pile resident in the lead and thereby prevent tipping;

providing a pile at a location adjacent to the pile driving apparatus and positioned substantially parallel to the ground;

using the lead drive system to position the lead substantially parallel to the ground;

using the counter-weight system to position the counter-weight so as to counteract the rotational moment associated with the positioning of a pile in the lead when the lead is substantially parallel to the ground; and moving the pile from the location adjacent to the pile driving apparatus to the lead while maintaining the pile substantially parallel to the ground.

15. A method, as claimed in claim 14, wherein:

the step of moving comprises using one of: a crawler crane, a straddle crane, and a pipe layer.

16. A method, as claimed in claim 14, wherein:

the step of moving comprises using a winch associated with the lead to pull the pile onto the lead.

17. A method, as claimed in claim 14, wherein:

the step of moving comprises moving the pile such that, immediately before the pile and the lead come into contact with one another, the longitudinal axis of the pile is separated from but substantially parallel to the longitudinal axis of the lead.

18. A method, as claimed in claim 14, wherein:

the step of moving comprises moving the pile such that, immediately before the pile and the lead come into contact with one another, the longitudinal axis of the pile is separated from but substantially colinear with the longitudinal axis of the lead.

19. A method, as claimed in claim 14, further comprising:

using the lead motor, after the pile is associated with the lead, to rotate the lead and the pile towards a desired substantially vertical position.

20. A method, as claimed in claim 19, further comprising:

using the weight drive system to cause the weight to be repositioned during the time that the lead and pile are being rotated between the substantially horizontal position and the desired substantially vertical position.

21. A method, as claimed in claim 19, further comprising:

using the weight drive system to cause the weight to be repositioned after the rotation of the lead and the pile has been stopped but prior to the lead and the pile reaching the desired substantially vertical position.

22. A method, as claimed in claim 19, further comprising:

using the weight drive system to cause the weight to be repositioned during rotation of the lead and the pile between the substantially horizontal position and the desired substantially vertical position.

* * * * *